US010311799B2

(12) United States Patent
Park et al.

(10) Patent No.: US 10,311,799 B2
(45) Date of Patent: Jun. 4, 2019

(54) DISPLAY DEVICE AND METHOD FOR CONTROLLING PEAK LUMINANCE OF THE SAME

(71) Applicant: Samsung Display Co., Ltd., Yongin-si, Gyeonggi-do (KR)

(72) Inventors: Seung-Ho Park, Suwon-si (KR); Jin-Ho Lee, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 99 days.

(21) Appl. No.: 15/428,969

(22) Filed: Feb. 9, 2017

(65) Prior Publication Data

US 2018/0005586 A1 Jan. 4, 2018

(30) Foreign Application Priority Data

Jun. 29, 2016 (KR) ..... 10-2016-0081865

(51) Int. Cl.

| | |
|---|---|
| ***G09G 3/3291*** | (2016.01) |
| ***G09G 3/20*** | (2006.01) |
| ***G09G 3/3266*** | (2016.01) |
| ***G09G 3/3233*** | (2016.01) |

(52) U.S. Cl.

CPC ..... *G09G 3/3291* (2013.01); *G09G 3/2007* (2013.01); *G09G 3/3233* (2013.01); *G09G 3/3266* (2013.01); *G09G 2300/0452* (2013.01); *G09G 2310/08* (2013.01); *G09G 2320/0233* (2013.01); *G09G 2320/041* (2013.01); *G09G 2320/066* (2013.01); *G09G 2320/0646* (2013.01); *G09G 2330/021* (2013.01); *G09G 2340/06* (2013.01); *G09G 2360/144* (2013.01); *G09G 2360/16* (2013.01)

(58) Field of Classification Search

CPC .. G09G 3/3291; G09G 3/2007; G09G 3/3233; G09G 3/3266; G09G 2300/0452; G09G 2310/08; G09G 2320/0233; G09G 2320/041; G09G 2320/0646; G09G 2320/066; G09G 2330/021; G09G 2340/06; G09G 2360/144; G09G 2360/16

USPC ..... 345/691

See application file for complete search history.

(56) References Cited

U.S. PATENT DOCUMENTS

| | | | | |
|---|---|---|---|---|
| 2007/0146252 | A1* | 6/2007 | Miller | G09G 3/3233 345/77 |
| 2008/0297448 | A1* | 12/2008 | Mizukoshi | G09G 3/3208 345/76 |
| 2014/0184655 | A1 | 7/2014 | Jang et al. | |

FOREIGN PATENT DOCUMENTS

KR 10-2014-0080312 A 6/2014

OTHER PUBLICATIONS 17163998.2, European Search Report dated Jun. 6, 2017, pp. 1-8.

* cited by examiner

*Primary Examiner* — Mark W Regn

(74) *Attorney, Agent, or Firm* — Innovation Counsel LLP

(57) ABSTRACT

A display device according to example embodiments includes an image analyzer configured to calculate contrast and load of an image of a frame based on R, G, and B image data input corresponding to the frame, an image processor configured to control a peak control coefficient applied to W image data to adaptively control peak luminance based on the contrast and the load, and to respectively generate R', G', and B' image data by subtracting a product of the W image data and the peak control coefficient from each of the R, G, and B image data, a display panel including a plurality of pixels, a data driver configured to generate a data signal based on the R', G', B, and W image data, and to provide the data signal to the display panel, and a scan driver configured to provide a scan signal to the display panel.

34 Claims, 20 Drawing Sheets

DISPLAY DEVICE AND METHOD FOR CONTROLLING PEAK LUMINANCE OF THE SAME

CROSS REFERENCE TO RELATED APPLICATION

This application claims priority to and the benefit of Korean Patent Application No. 10-2016-0081865, filed on Jun. 29, 2016 in the Korean Intellectual Property Office (KIPO), the disclosure of which is hereby incorporated by reference herein in its entirety.

BACKGROUND

1. Field

Example embodiments of the inventive concept relate to electronic devices. More particularly, example embodiments of the inventive concept relate to display devices and methods for controlling peak luminance of the same.

2. Discussion of Related Art

Organic light emitting diode (OLED) displays can display information such as images and characters by emitting light generated from an organic layer. This light is generated in the organic layer via the combination of holes supplied from an anode and electrons supplied from a cathode. OLED displays have advantages over traditional displays such as low power consumption, wide viewing angles, fast response times, stability at low temperatures, etc.

The organic light emitting display device applies peak luminance control (PLC) driving method for controlling peak luminance of display image based on RGB image data to reduce power consumption. The PLC driving method decreases the peak luminance according to an increase of an average grayscale level (or an average signal level of the image) to reduce the power consumption.

However, the conventional PLC driving method determines the peak luminance without considering environments such as contrast of the image, ambient light, temperature, etc, and thus visibility of the image decreases and the image deterioration occurs.

SUMMARY

Example embodiments provide a display device adaptively controlling peak luminance based on contrast and load of images.

Example embodiments provide a method for controlling adaptively controlling peak luminance of a display device based on contrast and load of images.

Example embodiments provide a display device adaptively controlling peak luminance based on contrast and load of images, ambient light and temperature.

According to example embodiments, a display device may comprise an image analyzer configured to calculate contrast and load of an image of a frame based on R, G, and B image data input corresponding to the frame, an image processor configured to control a peak control coefficient applied to W image data to adaptively control peak luminance based on the contrast and the load, and to respectively generate R', G', and B' image data by subtracting a product of the W image data and the peak control coefficient from each of the R, G, and B image data, a display panel including a plurality of pixels, a data driver configured to generate a data signal based on the R', G', B, and W image data, and to provide the data signal to the display panel, and a scan driver configured to provide a scan signal to the display panel.

In example embodiments, the peak luminance may increase when the peak control coefficient decreases.

In example embodiments, the image analyzer may determine the image of the frame as a normal image when the contrast is less than a predetermined first reference or the load is greater than a predetermined second reference; and wherein the image analyzer determines the image of the frame as a peak image which requires an increase of the peak luminance when the contrast is greater than the first reference and the load is less than the second reference.

In example embodiments, the image analyzer may comprise a calculator configured to calculate the contrast and the load based on a histogram of the R, G, and B image data, and a comparator configured to compare the contrast with the first reference and to compare the load with the second reference.

In example embodiments, the image processor may comprise a coefficient determiner configured to determine the peak control coefficient corresponding to the contrast, and a data converter configured to generate the W image data based on a minimum value among grayscales of the respective R, G, and B image data, and to generate the R', G', and B' image data by subtracting the product of the W image data and the peak control coefficient from the respective R, G, and B image data.

In example embodiments, the coefficient determiner may determine the peak control coefficient to 1 when the image of the frame is the normal image. The coefficient determiner may determine the peak control coefficient to a real number within a range greater than or equal to 0 and less than 1 based on the contrast when the image of the frame is the peak image.

In example embodiments, the peak control coefficient may have a uniform value regardless of the contrast when the image of the frame is the peak image.

In example embodiments, the peak control coefficient may decrease as a step function according to an increase of the contrast when the image of the frame is the peak image.

In example embodiments, the peak control coefficient may decrease linearly according to an increase of the contrast when the image of the frame is the peak image.

In example embodiments, the peak control coefficient may decrease as a step function according to an increase of a grayscale level when the image of the frame is the peak image.

In example embodiments, a first peak luminance corresponding to a first grayscale range may be less than a second peak luminance corresponding to a second grayscale range that has grayscales higher than grayscale levels within the first grayscale range.

In example embodiments, the data converter may comprise a minimum value selector configured to generate the W image data by selecting the minimum value among the grayscales of the R, G, and B image data, a coefficient applier configured to generate W' image data by multiply the W image data by the peak control coefficient, and a subtractor configured to subtract the W' image data from each of the R, G, and B image data to generate the R', G', and B' image data, respectively.

In example embodiments, peak control coefficients applied to the respective R, G, and B image data may be the same each other.

In example embodiments, at least one of peak control coefficients applied to the respective R, G, and B image data may be different.

In example embodiments, the image analyzer may determine whether or not an image displayed on a predetermined pixel block is the peak image, and wherein the peak control coefficient is independently calculated per the predetermined pixel block.

In example embodiments, the display device may further comprise an illuminance sensor configured to detect ambient light around the display panel, and a peak controller configured to determine a sub peak control coefficient based on the ambient light and to provide the sub peak control coefficient to the image processor, the sub peak control coefficient being additionally applied to the W image data.

In example embodiments, the peak controller may decrease the sub peak control coefficient at a predetermined interval according to an increase of the ambient light, when the ambient light is greater than a predetermined reference ambient light, and the image processor may generate R', G', and B' image data by subtracting a product of the W image data, the peak control coefficient and the sub peak control coefficient from each of the R, G, and B image data.

In example embodiments, the display device may further comprise a temperature sensor configured to detect a temperature of the display panel, and a peak controller configured to determine a sub peak control coefficient based on the temperature and to provide the sub peak control coefficient to the image processor, the sub peak control coefficient being additionally applied to the W image data.

In example embodiments, the peak controller may decrease the sub peak control coefficient at a predetermined interval according to a decrease of the temperature, when the temperature is less than a predetermined reference temperature, and the image processor may generate R', G', and B' image data by subtracting a product of the W image data, the peak control coefficient and the sub peak control coefficient from each of the R, G, and B image data.

In example embodiments, the image analyzer may further calculate a total sum of saturation of the image based on the R, G, and B image data when the image of the frame is the peak image.

In example embodiments, the display device may further comprise a peak controller configured to compare the total sum of saturation with a predetermined third reference, to determine a sub peak control coefficient and to provide the sub peak control coefficient to the image processor, the sub peak control coefficient being additionally applied to the W image data.

In example embodiments, the peak controller may decrease the sub peak control coefficient at a predetermined interval according to a decrease of the total sum of saturation, when the total sum of saturation is less than the third reference, and the image processor may generate R', G', and B' image data by subtracting a product of the W image data, the peak control coefficient and the sub peak control coefficient from each of the R, G, and B image data.

According to example embodiments, a method for controlling peak luminance of a display device may comprise calculating contrast and load of an image of a frame based on R, G, and B image data input corresponding to the frame, determining a peak control coefficient for adaptively controlling peak luminance based on the contrast and the load, generating W image data based on a minimum value among grayscales of the R, G, and B image data, generating R', G', and B' image data by subtracting a product of the W image data and the peak control coefficient from the R, G, and B image data, respectively, and generating a data signal based on the R', G', B', and W image data.

In example embodiments, the peak luminance may increase when the peak control coefficient decreases.

In example embodiments, determining the peak control coefficient may comprise determining the image of the frame as a normal image when the contrast is less than a predetermined first reference or the load is greater than a predetermined second reference, and determining the peak control coefficient to 1 when the image of the frame is the normal image.

In example embodiments, determining the peak control coefficient may further comprise determining the image of the frame as a peak image which requires an increase of the peak luminance when the contrast is greater than the first reference and the load is less than the second reference, and determining the peak control coefficient to a real number within a range greater than or equal to 0 and less than 1 based on the contrast when the image of the frame is the peak image.

In example embodiments, the peak control coefficient may have a uniform value regardless of the contrast or decreases as a step function according to an increase of the contrast, when the image of the frame is the peak image.

According to example embodiments, a display device may comprise an image analyzer configured to calculate contrast and load of an image of a frame based on R, G, and B image data input corresponding to the frame, an image processor configured to control a peak control coefficient applied to W image data to adaptively control peak luminance based on the contrast and the load, and to respectively convert the R, G, and B image data into R', G', B', and W image data based on the peak control coefficient, an illuminance sensor configured to detect ambient light around the display panel, a first peak controller configured to determine a first sub peak control coefficient based on the ambient light and to provide the sub peak control coefficient to the image processor, the first sub peak control coefficient being additionally applied to the W image data, a temperature sensor configured to detect a temperature of the display panel, a second peak controller configured to determine a second sub peak control coefficient based on the temperature and to provide the sub peak control coefficient to the image processor, the second sub peak control coefficient being additionally applied to the W image data, a display panel including a plurality of pixels, a data driver configured to generate a data signal based on the R', G', B, and W image data, and to provide the data signal to the display panel, and a scan driver configured to provide a scan signal to the display panel.

In example embodiments, the image analyzer may determine the image of the frame as a normal image when the contrast is less than a predetermined first reference and the load is greater than a predetermined second reference. The image analyzer may determine the image of the frame as a peak image which requires an increase of the peak luminance when the contrast is greater than the first reference and the load is less than the second reference.

According to example embodiments, a display device may comprise an image analyzer configured to decide a frame image characteristic, wherein the frame image characteristic includes a peak image which requires an increase of the peak luminance and a normal image, and is decided according to contrast and load of a frame image which is generated based on R, G, and B image data input of a frame, an image processor configured to receive the contrast and the frame image characteristic from the image analyzer and generate R', G', B', and W image data, a display panel including a plurality of pixels; a data driver configured to generate a data signal based on the R', G', B, and W image data, and to provide the data signal to the display panel, and a scan driver configured to provide a scan signal to the display panel, wherein the W image data W corresponds to a minimum value among the R image data R, G image data G, and B image data B, The R' G', and B' image data correspond to (R−W*PCC), (G−W*PCC), and (W*PCC), respectively, where PCC represents a peak control coefficient. The PCC is 1 when the frame image characteristic is the normal image and PCC is equal to or greater than 0 and less than 1 when the frame image characteristic is the peak image. The PCC may decrease as the contrast increases when the frame image characteristic is the peak image.

In example embodiments, the display device may further comprise an illumination sensor configured to detect ambient light around the display panel and a peak controller configured to determine a sub peak control coefficient based on the ambient light and to provide the sub peak control coefficient to the image processor. The sub peak control coefficient may decrease as the ambient light increases when the frame image characteristic is the peak image. The PCC may decrease as the sub peak control coefficient decreases.

In example embodiments, the display device may further comprise a temperature sensor configured to detect temperature of the display panel and a peak controller a sub peak configured to determine control coefficient based on the temperature of the display panel and to provide the sub peak control coefficient to the image processor. The sub peak control coefficient may increase as the temperature of the display panel increases when the frame image characteristic is the peak image. The PCC may decrease as the sub peak control coefficient decreases.

In example embodiments, the display device may further comprise a peak controller configured to compare a total sum of saturation with a predetermined reference to determine a sub peak control coefficient. The image analyzer may further calculate the total sum of saturation of the image based on the R, G, and B image data when the image characteristic is the peak image. The sub peak control coefficient may increase as the total sum of saturation of the image increases when the frame image characteristic is the peak image. The PCC may decrease as the sub peak control coefficient decreases.

In example embodiments, the display device may further comprise an illumination sensor configured to detect ambient light around the display panel and a first peak controller configured to determine a first sub peak control coefficient based on the ambient light and to provide the first sub peak control coefficient to the image processor; and a temperature sensor configured to detect temperature of the display panel and a second peak controller configured to determine a second sub peak control coefficient based on the temperature of the display panel and to provide the second sub peak control coefficient to the image processor. The first sub peak control coefficient may decrease as the ambient light increases when the frame image characteristic is the peak image. The second sub peak control coefficient may increase as the temperature of the display panel increases when the frame image characteristic is the peak image. The PCC may decrease as the first sub peak control coefficient or the second peak control coefficient decreases.

Therefore, the display device according to example embodiments may determine whether the peak image or not every frame and adaptively increase the peak luminance with respect to the peak image that has high contrast and low load, so that the visibility, reality and immersion of the image may be improved. Further, the peak luminance may be controlled by an adaptive image data conversion based on the peak control coefficient so that deterioration of the image quality may be reduced.

In addition, the display device may adaptive control the peak luminance based on at least one of the ambient light, the temperature of the display panel, the total sum of saturation of the image, etc with the contrast. Thus, the visibility of display may be improved and deterioration of display may be reduced.

BRIEF DESCRIPTION OF THE DRAWINGS

Example embodiments can be understood in more detail from the following description taken in conjunction with the accompanying drawings, in which.

DETAILED DESCRIPTION OF EMBODIMENTS

Exemplary embodiments will be described more fully hereinafter with reference to the accompanying drawings, in which various embodiments are shown.

Figure 1:
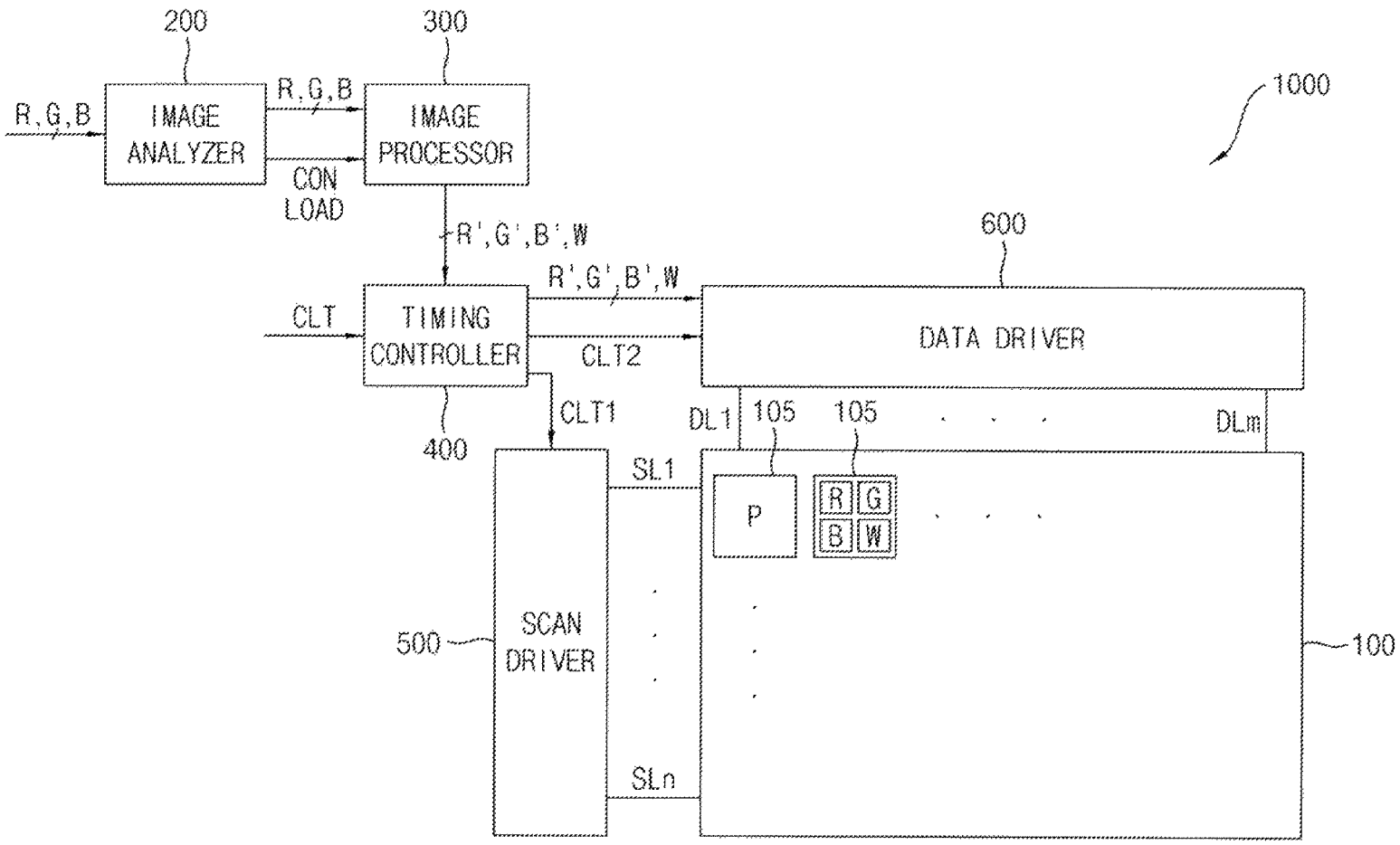
FIG. 1 is a block diagram of a display device according to example embodiments.

FIG. 1 is a block diagram of a display device according to example embodiments.

Referring to FIG. 1, the display device 1000 may include a display panel 100, an image analyzer 200, an image processor 300, a timing controller 400, a scan driver 500, and a data driver 600.

In one embodiment, the display device 1000 may be implemented as an organic light emitting display device or a liquid crystal display device. Since these are examples, the display device 1000 is not limited thereto.

The display panel 100 may display images. The display panel 100 may include a plurality of scan lines SL1 through SLn and a plurality of data lines DL1 through DLm. The display panel 100 may also include the pixels P connected to the scan lines SL1 through SLn and the data lines DL1 through DLm. For example, the pixels P may be arranged in a matrix form. In some embodiments, the number of pixels P may be equal to n×m, where n and m are integers greater than 0. In some embodiments, each of the pixels P may include 4 sub pixels, for example, a red sub pixel R, a green sub pixel G, a blue sub pixel B, and a white sub pixel W. Since an arrangement of the sub pixels illustrated in FIG. 1 is an example, the arrangement of the sub pixels is not limited thereto.

Each of the sub pixels may include a switching transistor, a driving transistor, a storage capacitor, and an organic light emitting diode (OLED). Some embodiments, the OLED may be a white OLED which emit white light in which the red, green and blue sub pixels may be implemented by color filters having a red, green and blue color filters, respectively. Since these are examples, structures of the sub pixels are not limited thereto.

The image analyzer 200 may calculate contrast CON and load LOAD of an image of a frame based on R, G, and B image data R, G, B input corresponding to the frame. The R, G, and B image data R, G, B may correspond to red image data R, green image data G, and blue image data B, respectively. The contrast CON may be a proportion of a low-grayscale range to a high-grayscale range in a whole image of one frame. The load LOAD may be a proportion of an average signal level (e.g., an average grayscale) of the present frame to a signal level of a full-white image. In some embodiments, the image analyzer 200 may include a calculator configured to calculate the contrast CON and the load LOAD based on a histogram of the R, G, and B image data R, G, B and a comparator configured to compare the contrast CON with a predetermined first reference and to compare the load LOAD with a predetermined second reference.

The image analyzer 200 may provide the R, G, and B image data R, G, B, the contrast CON and the load LOAD to the image processor 300.

The image analyzer 200 may determine the image of the frame as a normal image or a peak image, which requires an increase of peak luminance, based on the contrast CON and the load LOAD provided from the image analyzer 200. In some embodiments, the image analyzer 200 may determine the image of the frame as the normal image when the contrast CON is less than the first reference or the load LOAD is greater than the second reference. In some embodiments, the image analyzer 200 may determine the image of the frame as the peak image which requires an increase of the peak luminance when the contrast CON is greater than the first reference and the load LOAD is less than the second reference. For example, when a high grayscale (or high luminance) portion partially exists in a dim image, the peak luminance may be increased and visibility may be improved.

The image processor 300 may control a peak control coefficient applied to W image data to adaptively control peak luminance according to the contrast CON and the load LOAD, and convert the R, G, and B image data R, B into R', G', B', and W image data R', G', B', W based on the peak control coefficient. The W image data W may be converted image data obtained using the R, G, and B image data R, G, B to emit white light. In some embodiments, the image processor 300 may include a coefficient determiner configured to determine the peak control coefficient corresponding to the contrast CON, and a data converter configured to generate the W image data W based on a minimum value among grayscales of the R, G, and B image data R, B, and to generate the R', G', and B' image data R', G', B' by subtracting the product of the W image data W and the peak control coefficient from the respective R, G, and B image data R, G, B.

In some embodiments, the peak luminance may increase when the peak control coefficient decreases.

The peak control coefficient may be determined as 1 when the image of the frame is the normal image. Thus, the peak luminance in this case may be determined by only the W image data W and an emission of the white sub pixel.

The peak control coefficient may be determined to a real number within a range greater than or equal to 0 and less than 1 when the image of the frame is the peak image for increasing the peak luminance. In this, the peak luminance may be determined by the W image data W and at least one of the R, G, and B image data R, G, B. Thus, the peak luminance may be greater than that of the normal image.

The peak control coefficient may have a uniform value regardless the contrast CON or decrease as a step function according to an increase of the contrast CON when the image of the frame is the peak image. In some embodiments, peak control coefficients applied to the respective R, G, and B image data R, G, B may have the same value. In contrast, at least one of the peak control coefficients applied to the respective R, G, and B image data R, G, B may have a different value.

In some embodiments, the peak control coefficient may changes according to a grayscale level in the peak image. For example, the peak control coefficient may decrease as a step function according to an increase of the grayscale level.

In some embodiments, the contrast CON and load LOAD calculation may be performed with a predetermined pixel block as a unit. Accordingly, conversions of the R, G, and B image data R, G, B may be performed independently. Thus, the peak control coefficient determined by each pixel block may be different each other.

The image processor 300 may provide the converted R', G', B', and W image data R', G', B', and W to the timing controller 400.

The timing controller 400 may control the scan driver 500 and the data driver 600 based on a control signal CLR received from external devices, for example, a graphic controller. The control signal CLR may include a vertical synchronization signal, a horizontal synchronization signal, a data enable signal, a clock signal, and so on. The timing controller 400 may generate a first control signal CLT1 for controlling a driving timing of the scan driver 500 and provide the first control signal CLT1 to the scan driver 500. In some embodiments, the timing controller 400 may provide the R', G', B', and W image data R', G', B', W to the data driver 600. The timing controller 400 may generate a second control signal CLT2 for controlling a driving timing of the data driver 600 and provide the second control signal CLT2 to the data driver 600. In some embodiments, the timing controller 400 may generate a data signal (e.g., digital data signals) corresponding to operating conditions of the display panel 100 based on the R', G', B', and W image data R', G', B', W and provide the data signal to the data driver 600.

In some embodiments, at least one of the image analyzer 200 and the image processor 300 may be included in the timing controller 400.

The scan driver 500 may provide a plurality of scan signals to the display panel 100. The scan driver 500 may output the scan signals to the display panel 100 via the scan lines SL1 through SLn in response to the first control signal CLT1 received from the timing controller 400.

The data driver may convert the R', G', B', and W image data R', G', B', W or the data signal into an analog type data voltage in response to a second control signal CLT2 received from the timing controller 400 and may apply the data voltage to the data lines DL1 through DLm.

As described above, the display device 1000 may determine whether the frame image is the peak image or not in every frame and adaptively increase the peak luminance when the frame image is the peak image that has high contrast and low load, so that the visibility, reality and immersion of the image may be improved. Further, the peak luminance may be controlled by an adaptive image data conversion using the peak control coefficient so that deterioration of the image quality may be reduced.

Figure 2:
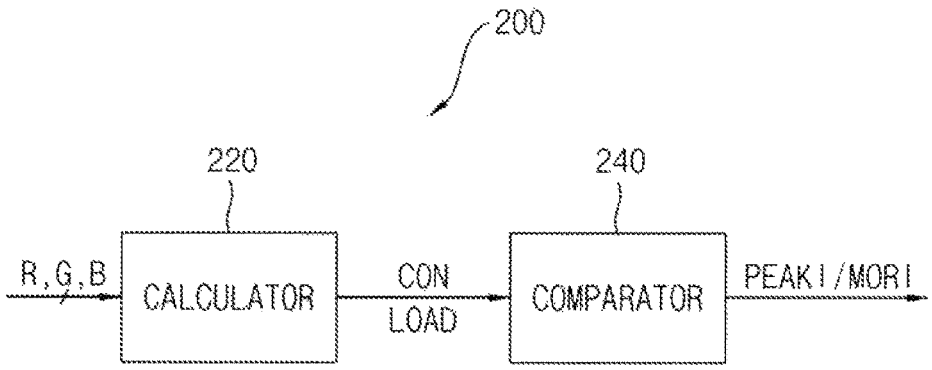
FIG. 2 is a block diagram illustrating an example of an image analyzer included in the display device of FIG. 1, FIGS. 3A and 3B illustrate examples of which the image analyzer of FIG. 2 analyzes an image.
Figure 3A:
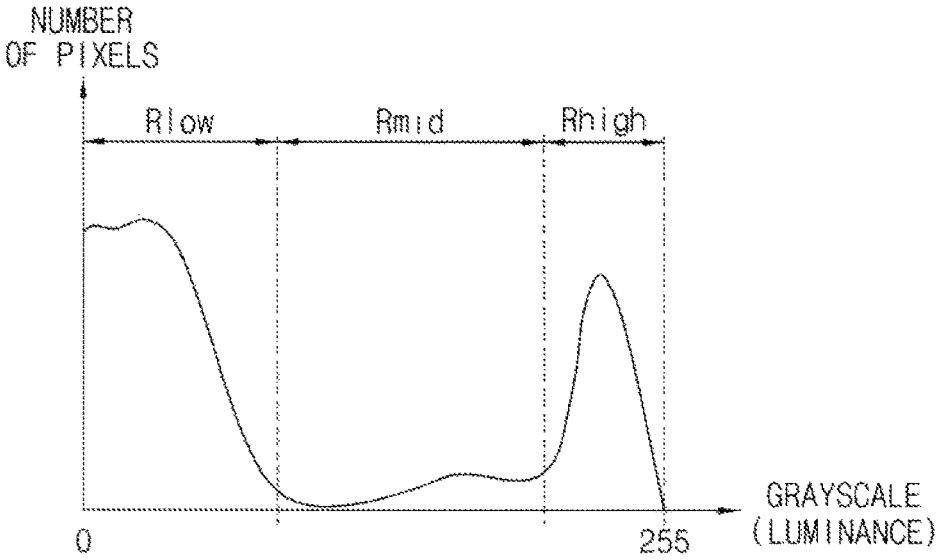
Figure 3B:
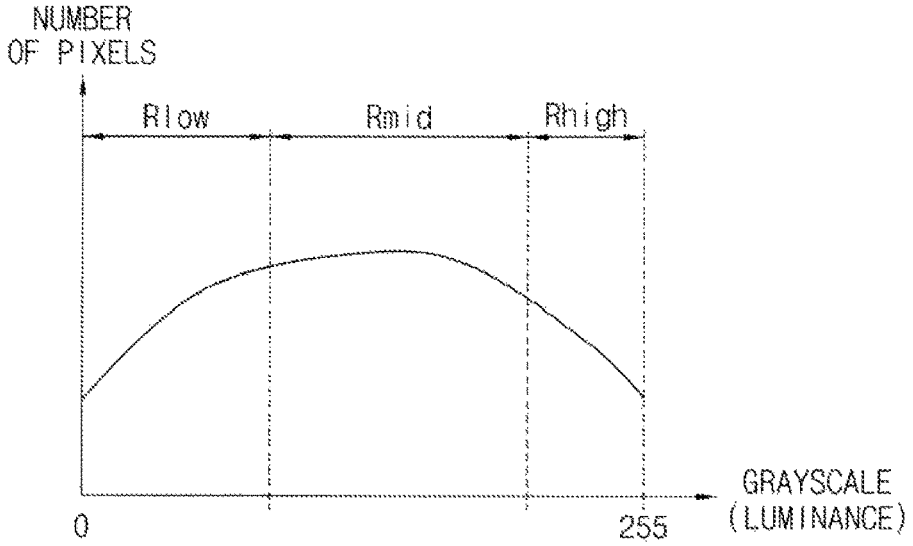

FIG. 2 is a block diagram illustrating an example of an image analyzer included in the display device of FIG. 1. FIGS. 3A and 3B illustrate examples of which the image analyzer of FIG. 2 analyzes an image.

Referring to FIGS. 2 through 3B, the image analyzer 200 may include a calculator 220 and a comparator 240.

The calculator 220 may calculate the contrast CON and the load LOAD based on a histogram of the R, G, and B image data R, G, B. The calculator 220 may calculate the contrast CON and the load LOAD at a predetermined frame interval. In some embodiments, the calculator 220 may calculate the contrast CON and the load LOAD every frame.

The calculator 220 may calculate a luminance histogram of all pixels from the R, G, and B image data R, G, B as illustrated in FIGS. 3A and 3B. An X axis of the histogram represents the luminance (or the grayscale level) and a Y axis represents the number of pixels. For example, FIG. 3A shows the histogram of an image having a relatively high contrast CON, and FIG. 3B shows the histogram of an image having a relatively low contrast CON.

The luminance of the image data may be defined by a plurality of grayscales. For example, the luminance may be divided into 0 to 255 grayscale levels and the luminance may increase according to an increase of the grayscale level. A low-grayscale proportion Rlow, a mid-grayscale proportion Rmid and a high-grayscale proportion Rhigh may be calculated from the histogram. For example, a low-grayscale range for calculating the low-grayscale proportion Rlow may include a 0 grayscale level to a 64 grayscale level and a high-grayscale range for calculating the high-grayscale proportion Rhigh may include a 200 grayscale level to a 255 grayscale level. A mid-grayscale range may correspond to between the low-grayscale range and the high-grayscale range. The contrast CON may be calculated based on the low-grayscale proportion Rlow, the mid-grayscale proportion Rmid and the high-grayscale proportion Rhigh.

Further, the load LOAD that is a proportion of an average signal level of a present frame to a signal level of a full-white image may be calculated by the histogram.

The comparator 240 may determine the frame image as a peak image PEAKI for increasing peak luminance or a normal image NORI based on the contrast CON and the load LOAD. In some embodiments, the comparator 240 may compare the contrast CON with a predetermined first reference and compare the load LOAD with a predetermined second reference. The frame image may be determined as the peak image PEAKI by satisfying a condition that the contrast CON is higher than the first reference and the load LOAD is lower than the second reference.

In some embodiments, the comparator 240 may determine the image of the frame as the peak image PEAKI when the contrast CON is greater than the first reference and the load is less than the second reference. In contrast, the comparator 240 may determine the image of the frame as the normal image NORI when the contrast CON is less than the first reference or the load LOAD is greater than the second reference.

For example, the first reference may include a reference value with respect to the low-grayscale proportion Rlow and a reference value with respect to the high-grayscale proportion Rhigh. For example, when the low-grayscale proportion Rlow is over about 60% and the high-grayscale proportion Rhigh is over about 10%, the image of the frame may be the high contrast image. The contrast CON may be digitized by the calculation. The higher the digitized contrast CON is, the wider areas of low-grayscale portion and high-grayscale portion exist. And, in the high contrast CON, the image of the frame may provide sufficient contrast.

In some embodiments, the second reference may be determined to about 15%. That is, the peak image PEAKI may have entirely dim image including high-grayscale portions. For example, the peak image PEAKI may be a night scene image partially having high-grayscale portions.

Accordingly, when the load LOAD is lower than 15% and the low-grayscale proportion Rlow is over about 60% and the high-grayscale proportion Rhigh is over about 10%, the image of the frame may be determined as the peak image PEAKI.

However, this is an example, and the references for determining whether the image is the peak image PEAKI or not are not limited thereto.

The calculator 220 and the comparator 240 may provide the contrast CON and the result of the determination to the image processor 300.

In some embodiments, the calculations of the contrast CON and the load LOAD and the determination whether or not an image displayed on a predetermined pixel block is the peak image PEAKI. Accordingly, the peak control coefficient PCC may be independently calculated per pixel block.

The peak luminance of the frame may be adaptively controlled by the determination whether the image is the peak image PEAKI or not.

Figure 4:
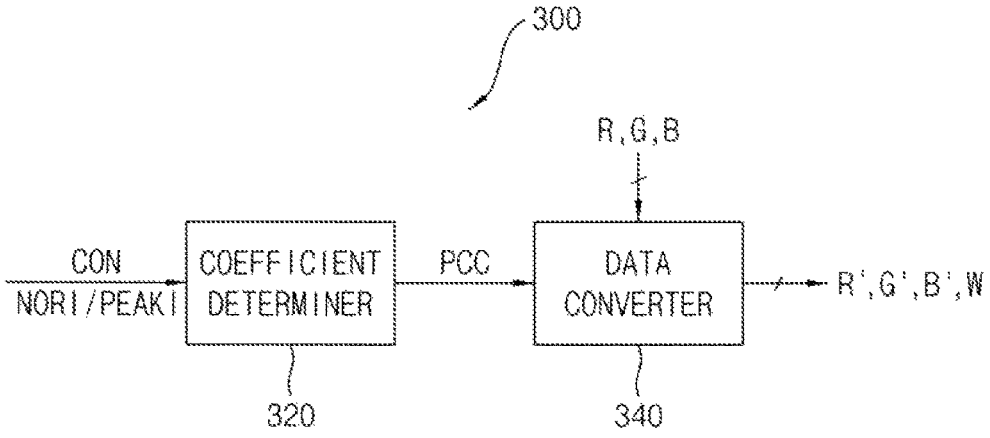
FIG. 4 is a block diagram illustrating an example of an image processor included in the display device of FIG. 1.

FIG. 4 is a block diagram illustrating an example of an image processor included in the display device of FIG. 1.

Referring to FIG. 4, the image processor 300 may include a coefficient determiner 320 and a data converter 340.

The coefficient determiner 320 may determine a peak control coefficient PCC according to the contrast CON. In some embodiments, the coefficient determiner 320 may determine the peak control coefficient PCC based on the normal image NORI and the peak image PEAKI. The peak control coefficient PCC may be multiplied to the W image data W to control the peak luminance. In some embodiments, the lower the peak control coefficient PCC is, the higher the peak luminance is.

When the image of the frame is the normal image NORI, the coefficient determiner 320 may determine the peak control coefficient PCC to 1. When the peak luminance of the normal image NORI is about 500 nit, the peak luminance may be represented by an emission of only white sub pixels (i.e., only the W image data).

When the image of the frame is the peak image PEAKI, the coefficient determiner 320 may determine the peak control coefficient PCC based on the contrast CON. Here, the peak control coefficient PCC may be real number within a range greater than or equal to 0 and less than 1. In some embodiments, the coefficient determiner 320 may determine the peak control coefficient PCC to have a uniform value regardless the contrast CON. In some embodiments, the coefficient determiner 320 may determine the peak control coefficient PCC to be changed according to a value of the contrast CON. For example, the coefficient determiner 320 may include a lookup table having a relation between the contrast CON and the peak control coefficient PCC, or may change the peak control coefficient PCC using a formula (or a function) that has a contrast CON as a variable.

The coefficient determiner 320 may provide the peak control coefficient PCC to the data converter 340.

The data converter 340 may generate the W image data W based on a minimum value among grayscales of the respective R, G, and B image data R, G, B. The respective grayscales may represent luminances of the respective R, G, and B image data R, G, B. For example, each of the grayscales may be implemented by 8 bit digital data (e.g., 0 to 255 grayscale levels). The data converter 340 may extract the minimum value (e.g., a minimum grayscale level) from the digitized grayscale levels (or the digitized luminances). However, this is an example, and forms of the digital data representing the grayscale levels are not limited thereto.

Luminance efficiency of the respective red sub pixel, green sub pixel, and blue sub pixel are different from each other. Thus, even though all of the R, G, and B image data R, G, B have the same grayscale level, the red, green, and blue sub pixels may emit light each having different luminance. For example, when all of the R, G, and B image data R, G, B have 255 grayscale level (i.e., a maximum grayscale level), the red sub pixel may emit light with about 100 nit, the green sub pixel may emit light with about 300 nit, and the blue sub pixels may emit light with about 50 nit. Here, the peak luminance may correspond to about 450 nit that is a sum of the luminances of the red, green, and blue sub pixels.

In some embodiments, the W image data W may be calculated by Equation 1.

$$W=\min(R,G,B) \quad \text{Equation 1}$$

In Equation 1, the W image data W may correspond to the minimum value among the R, G, and B image data R, G, B. For example, when all of the R, G, and B image data R, G, B have the 255 grayscale level (i.e., the maximum grayscale level), the minimum value may correspond to the 255 grayscale level and the W image data W may have digital data corresponding to the 255 grayscale level.

The data converter 340 may generate the R', G', and B' image data R', G', B' by subtracting the product of the W image data W and the peak control coefficient PCC from the respective R, G, and B image data R, G, B. In some embodiments, the R', G', and B' image data R', G', B' may be converted from the R, G, and B image data R, G, B by Equation 2, respectively.

$$R'=R-W*PCC$$

$$G'=G-W*PCC$$

$$B'=B-W*PCC \quad \text{Equation 2}$$

The peak control coefficient PCC may be 1 when the image of the frame is the normal image NORI. Thus, the R', G', and B' image data R', G', B' may correspond to (R−W), (G−W), and (B−W), respectively. When the image of the frame is the peak image PEAKI, the peak control coefficient PCC is less than 1 so that the R', G', and B' image data R', G', B' may be respectively greater than (R−W), (G−W), and (B−W). Thus, when all of the R, G, and B image data R, G, B have the 255 grayscale level (i.e., the maximum grayscale level), the W image data W may have the digital data corresponding to the 255 grayscale level and the respective R', G', and B' image data R', G', B' may have specific grayscale levels greater than 0. Accordingly, all the red, green, blue, and white sub pixels may emit light and the peak luminance may increase.

In some embodiments, peak control coefficients PCC applied to the respective R, G, and B image data R, G, B may have the same value. In some embodiments, at least one of peak control coefficients applied to the respective R, G, and B image data R, G, B may have a different value. Accordingly, the peak control coefficient PCC may be different according to the R, G, and B image data R, G, B in consideration of each of the emission efficiencies of the sub pixels.

In some embodiments, the data converter 340 may include a minimum value selector, a coefficient applier, and a subtractor to generate the R', G', and B' image data R', G', B'.

Figure 5A:
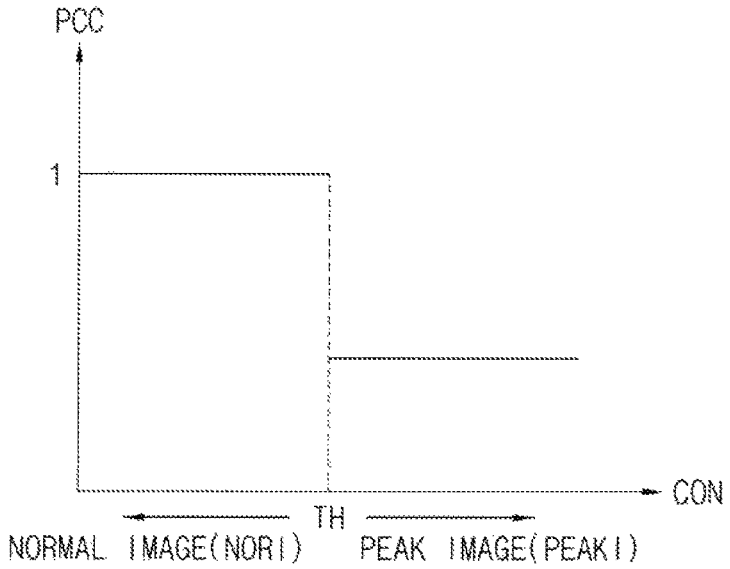
FIG. 5A is a graph illustrating an example of a peak control coefficient determined by the image processor of FIG. 4.
Figure 5B:
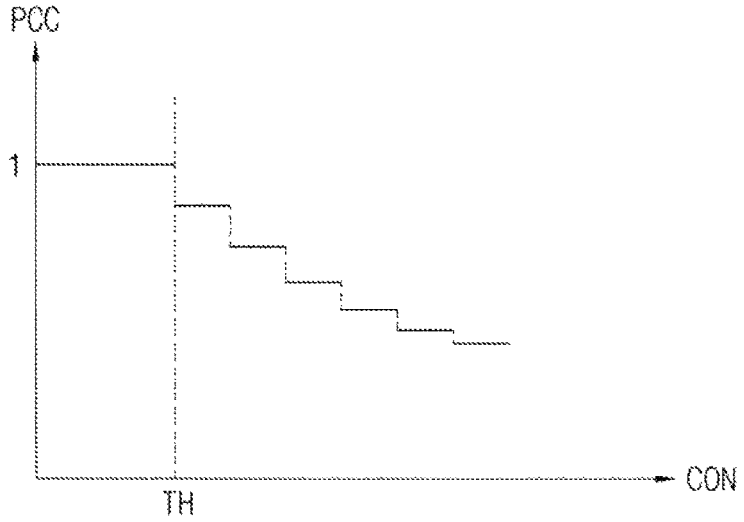
FIG. 5B is a graph illustrating another example of a peak control coefficient determined by the image processor of FIG. 4.
Figure 5C:
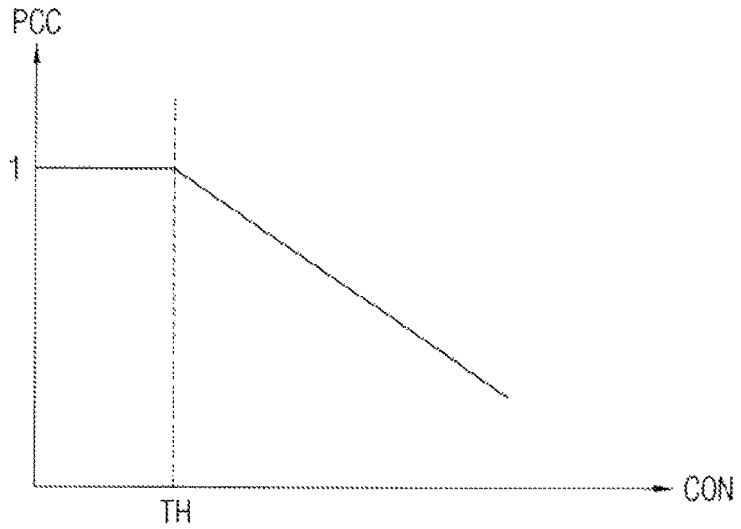
FIG. 5C is a graph illustrating still another example of a peak control coefficient determined by the image processor of FIG. 4.

FIG. 5A is a graph illustrating an example of a peak control coefficient determined by the image processor of FIG. 4. FIG. 5B is a graph illustrating another example of a peak control coefficient determined by the image processor of FIG. 4. FIG. 5C is a graph illustrating still another example of a peak control coefficient determined by the image processor of FIG. 4.

Referring to FIGS. 4 through 5C, the peak control coefficient PCC may be adaptively controlled according to the peak image PEAKI and the normal image NORI. The peak control coefficient PCC may further controlled according to the contrast CON in the peak image PEAKI.

In some embodiments, the peak control coefficient PCC may be determined to 1 in the normal image NORI.

As illustrated in FIG. 5A, the peak control coefficient PCC may have a uniform value regardless the contrast CON in the peak image PEAKI that the contrast CON of the image of the frame is greater than a reference contrast TH. For example, the peak control coefficient PCC may be determined to 0.5 in the peak image PEAKI. Thus, in the same R, G, and B image data, peak luminance of the peak image PEAKI may be relatively higher than peak luminance of the normal image NORI.

As illustrated in FIG. 5B, the peak control coefficient PCC may decrease as a step function according to an increase of the contrast CON in the peak image PEAKI that the contrast CON of the image of the frame is greater than a reference contrast TH. Accordingly, the peak control coefficient PCC may be changed based on specific contrast ranges. Here, as the contrast CON increases, the peak luminance may increase as a step function.

As illustrated in FIG. 5C, the peak control coefficient PCC may linearly decrease according to an increase of the contrast CON in the peak image PEAKI that the contrast CON of the image of the frame is greater than a reference contrast TH. Here, as the contrast CON increases, the peak luminance may increase.

However, these are examples, and methods for adjusting the peak control coefficient PCC are not limited thereto. For example, the peak control coefficient PCC may change as an exponential function in the peak image PEAKI.

Accordingly, the peak control coefficient PCC in the peak image PEAKI is lower than the peak control coefficient PCC in the normal image NORI, so that the peak luminance in the peak image PEAKI that has relatively higher contrast than the normal image NORI may be higher than the peak luminance in the normal image NORI. Further, the peak luminance may increase according to the increase of the contrast CON of the peak image PEAKI.

Figure 6:
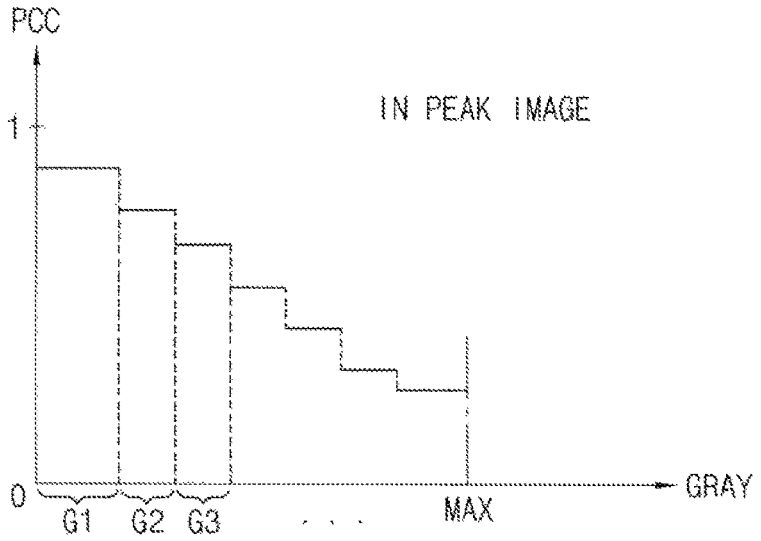
FIG. 6 is a graph illustrating an example of a peak control coefficient by the image processor of FIG. 4 based on grayscales.

FIG. 6 is a graph illustrating an example of a peak control coefficient obtained by the image processor of FIG. 4 according to grayscales.

Referring to FIGS. 4 and 6, the peak control coefficient PCC may be adaptively controlled according to a grayscale level GRAY in the peak image.

FIG. 6 shows the peak control coefficient PCC changes according to the grayscale level GRAY in a specific contrast. In some embodiments, the peak control coefficient PCC may decrease as a step function according to an increase of the grayscale level GRAY. Accordingly, the peak control coefficient PCC may be determined by predetermined grayscale ranges G1, G2, G3, . . . . Thus, in the peak image, a first peak luminance corresponding to a first grayscale range G1 may be lower than a second peak luminance corresponding to a second grayscale range G2. Therefore, a luminance range in the first grayscale range G1 (e.g., a low-grayscale range) may be less than a luminance range in the second grayscale range G2.

However, this is an example, and methods for adjusting the peak control coefficient PCC are not limited thereto. For example, the number of the grayscale ranges and a range of each grayscale range are set by experiments. And, the peak control coefficient PCC may change as an exponential function, a linear function, and so on, in the peak image PEAKI.

As described above, the peak control coefficient PCC may be changed according to the grayscale level GRAY so that a rapid increase of the luminance in the low-grayscale range by the increase of the peak luminance can be prevented.

Figure 7A:
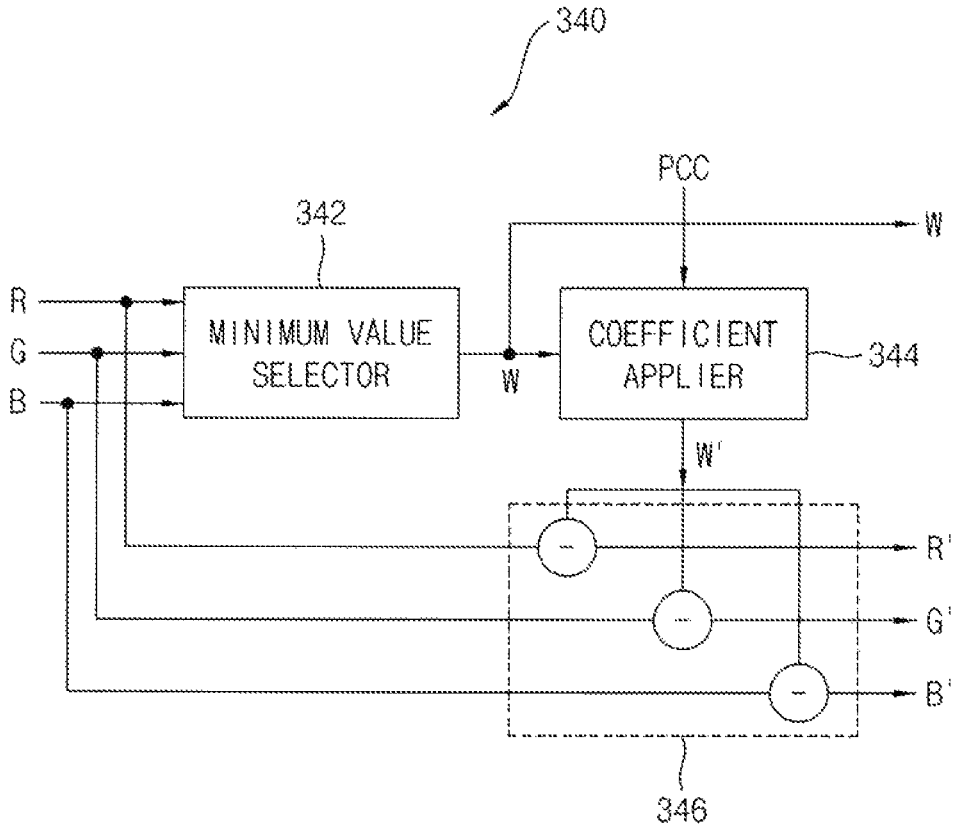
FIG. 7A is a block diagram illustrating an example of a data converter included in the image processor of FIG. 4.
Figure 7B:
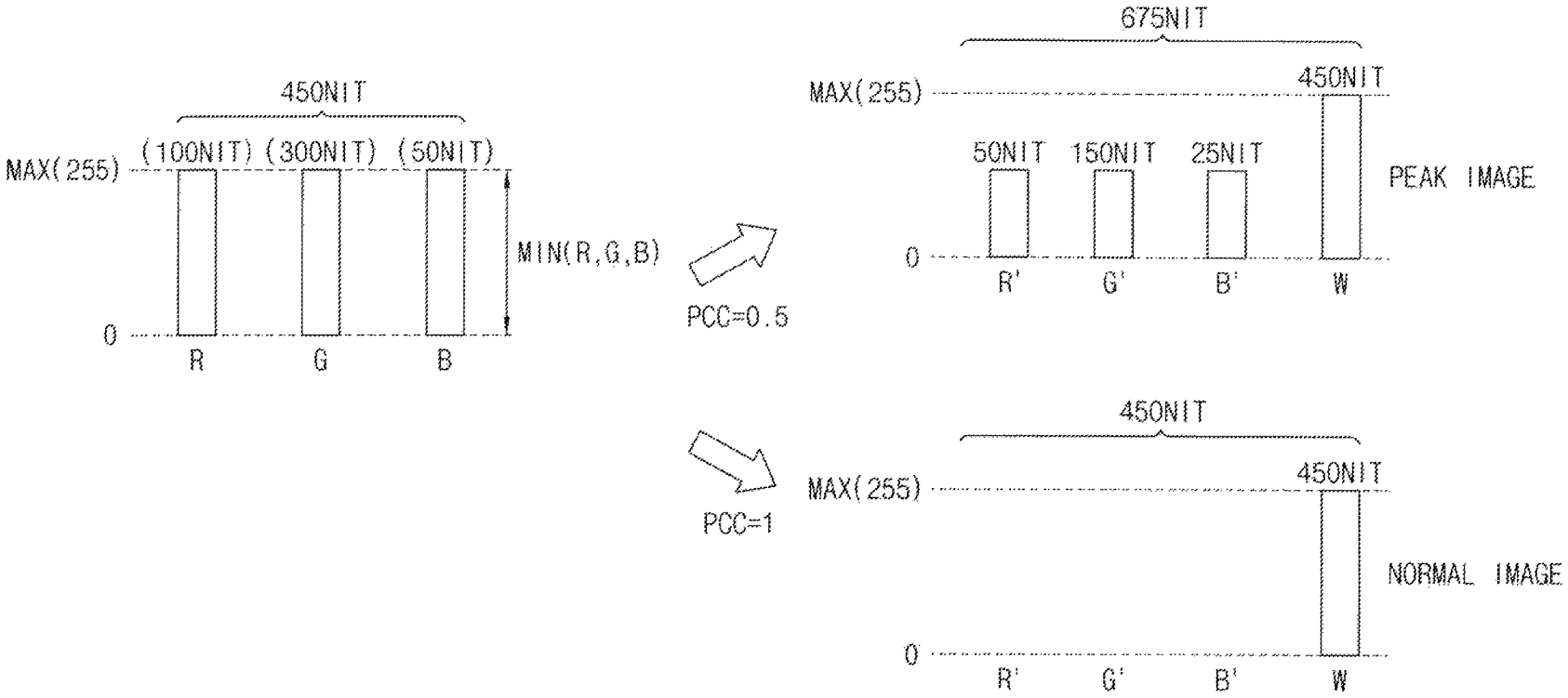
FIG. 7B is a diagram illustrating an example of image data converted by the data converter of FIG. 7A.

FIG. 7A is a block diagram illustrating an example of a data converter included in the image processor of FIG. 4. FIG. 7B is a diagram illustrating an example of image data converted by the data converter of FIG. 7A.

Referring to FIGS. 2 through 7B, the data converter 340 may include a minimum value selector 342, a coefficient applier 344, and a subtractor 346.

The minimum value selector 342 may generate the W image data W by selecting the minimum value among the grayscales of the R, G, and B image data R, G, and B. The grayscale of the R image data R may represent luminance corresponding to the R image data R. The grayscale of the G image data G may represent luminance corresponding to the G image data G The grayscale of the B image data B may represent luminance corresponding to the B image data B. The minimum value selector 342 may receive the R, G, and B image data R, G, and B from the image analyzer 200 or an external graphic source and extract the minimum value of digitized luminance (e.g., a minimum grayscale level). In some embodiments, the minimum value selector 342 may calculate the W image data W using the Equation 1.

For example, as illustrated in FIG. 7B, the luminance of the respective R, G, and B image data R, G, and B may be divided into 0 to 255 grayscale levels. Emission luminances of the maximum grayscale level with respect to the respective R, G, and B image data R, G, and B may be about 100 nit, 300 nit, and 50 nit, respectively. Thus, the peak luminance by the R, G, and B image data R, G, and B may correspond to about 450 nit. When all of the R, G, and B image data have the 255 grayscale level (i.e., the maximum grayscale level), the minimum value may correspond to the 255 grayscale level and the W image data W may have digital data corresponding to the 255 grayscale level. A white sub pixel arranged in the display panel may emit light based on the W image data W.

The coefficient applier 344 may generate W' image data W' by multiply the W image data W by the peak control coefficient PCC (i.e., W'=W*PCC). In some embodiments, the peak control coefficient PCC may be greater than or equal to 0 and less than 1 when the image of the frame is the peak image PEAKI. Thus, the W' image data W' may be less than the W image data W in the peak image PEAKI.

The subtractor 346 may subtract the W' image data W' from each of the R, G, and B image data R, G, and B to generate the R', G', and B' image data R', G', and B', respectively. Accordingly, the Equation 2 may be expressed by Equation 3.

$$R'=R-W'$$

$$G'=G-W'$$

$$B'=B-W' \qquad \text{Equation 3}$$

Accordingly, the R, G, and B image data R, G, and B may be converted into the R', G', and B' image data R', G', and B', respectively. The R', G', and B' image data R', G', and B' may have newly updated grayscale levels, respectively.

As illustrated in FIG. 7B, when the peak control coefficient PCC is 0.5, the W' image data W' may be half of the W image data W and the R', G', and B' image data R', G', and B' may be respectively half of the R, G, and B image data R, G, and B. The red, green, and blue sub pixels may emit lights based on the R', G', and B' image data R', G', and B', respectively. Accordingly, all the red, green, blue, and white sub pixels may emit lights and the peak luminance may be about 675 nit.

In contrast, as illustrated in FIG. 7B, when the peak control coefficient PCC is 1 (i.e., in the normal image NORI), the R', G', and B' image data R', G', and B' may be 0 (e.g., the 0 grayscale level) and the red, green, and blue sub pixels may not emit light. Here, only the white sub pixel may emit light and the peak luminance may be about 450 nit.

Accordingly, the peak luminance in the peak image PEAKI may be improved about 1.5 times of the normal image NORI, when the peak control coefficient PCC is 0.5. Thus, the visibility, reality and immersion of the peak image PEAKI having relatively low load and high contrast may be improved.

Figure 8:
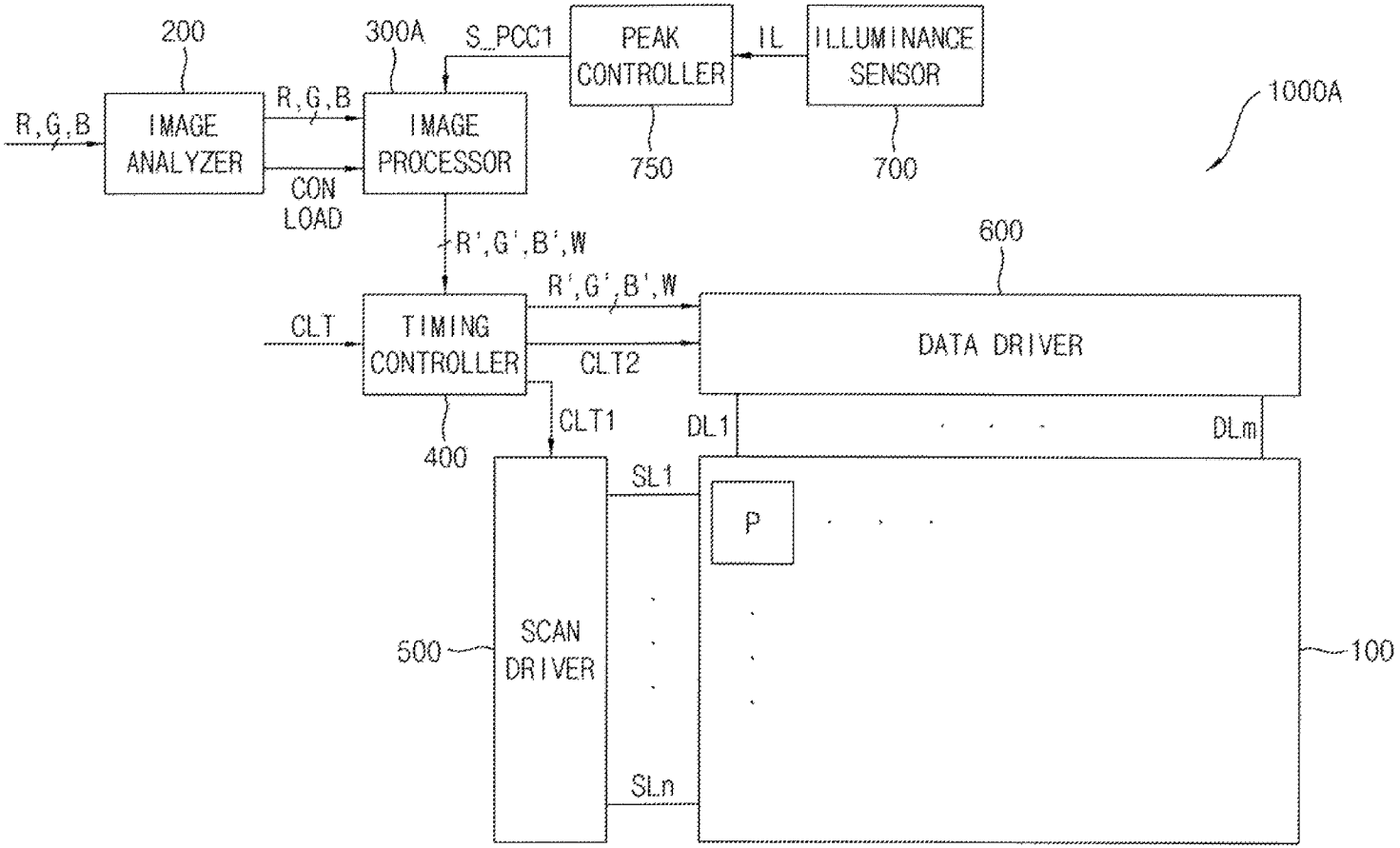
FIG. 8 is a block diagram of a display device according to example embodiments.

FIG. 8 is a block diagram of a display device according to example embodiments.

The display device of the present example embodiments are substantially the same as the display device explained with reference to FIGS. 1 through 7B except for constructions of an illuminance sensor, a peak controller, and an image processor. Thus, the same reference numerals will be used to refer to the same or like parts as those described in the example embodiments of FIGS. 1 through 7B, and any repetitive explanation concerning the above elements will be omitted.

Referring to FIG. 8, the display device 1000A may include a display panel 100, an image analyzer 200, an image processor 300A, a timing controller 400, a scan driver 500, a data driver 600, an illuminance sensor 700, and a peak controller 750.

The display panel 100 may include a plurality of pixels P each having a red sub pixel, a green sub pixel, a blue sub pixel, and a white sub pixel.

The image analyzer 200 may calculate contrast CON and load LOAD of an image of a frame based on R, G, and B image data R, G, B input corresponding to the frame. The image analyzer 200 may provide the R, G, and B image data R, B, the contrast CON and the load LOAD to the image processor 300A. The image analyzer 200 may determine the image of the frame as a normal image or a peak image.

The image processor 300A may control a peak control coefficient applied to W image data to adaptively control peak luminance according to the contrast CON and the load LOAD. The image processor 300A may receive a sub peak control coefficient S_PCC1 generated based on an ambient light IL from the peak controller 750. The sub peak control coefficient S_PCC1 may be used to determine the peak control coefficient or the W image data W. In some embodiments, the peak control coefficient may be affected by the sub peak control coefficient S_PCC1. For example, the sub peak control coefficient S_PCC1 may be multiplied to the peak control coefficient to get a corrected peak control coefficient. The image processor 300A may convert the R, G; and B image data R, B into R', G', and B' image data R', G', B' based on the corrected peak control coefficient which is determined considering the sub peak control coefficient S_PCC1. In some embodiments, the image processor 300A may adaptively control the peak luminance based on the contrast CON, the load LOAD, and the ambient light IL.

The illuminance sensor 700 may detect the ambient light around the display panel 100. When the ambient light is high, the visibility of the image may be reduced by a reflection of external light. Accordingly, the detected ambient light IL may be additionally applied to the R, G, and B image data R, G, B to control the peak luminance.

The peak controller 750 may determine the sub peak control coefficient S_PCC1 based on the ambient light IL. The peak controller 750 may provide the sub peak control coefficient S_PCC1 to the image processor 300A. In some embodiments, the peak controller 750 may only be activated when the ambient light IL is greater than a predetermined reference ambient light. The peak controller 750 may decrease the sub peak control coefficient S_PCC1 at a predetermined interval according to an increase of the ambient light IL. Accordingly, the corrected peak control coefficient to which the sub peak control coefficient S_PCC1 is considered may decrease according to the increase of the ambient light IL. Thus, the peak luminance may increase according to the increase of the ambient light IL, so that the visibility of the image in the high ambient light (or bright surroundings) and/or the high contrast image may be improved.

In some embodiments, the peak controller 750 may be included in the image processor 300A.

In some embodiments, when the ambient light IL is less than or equal to the reference ambient light, the peak controller 750 is disabled. Thus, the peak luminance control operations as described above with reference to FIGS. 1 through 7B may be performed.

The timing controller 400 may control the scan driver 500 and the data driver 600 based on a control signal CLT received from external devices. The scan driver 500 may provide a plurality of scan signals to the display panel 100. The data driver may convert the R', G', B', and W image data R', G', B', W or the data signal into an analog type data voltage based on a second control signal CLT2 received from the timing controller 400 and may apply the data voltage to the data lines DL1 through DLm.

As described above, the display device 1000A may adaptively control the peak luminance based on the contrast CON, the load LOAD, and the ambient light IL. Thus, the visibility, reality and immersion of the image may be improved. Further, the peak luminance may be controlled by an adaptive image data conversion based on the corrected peak control coefficient so that deterioration of the image quality may be reduced.

Figure 9A:
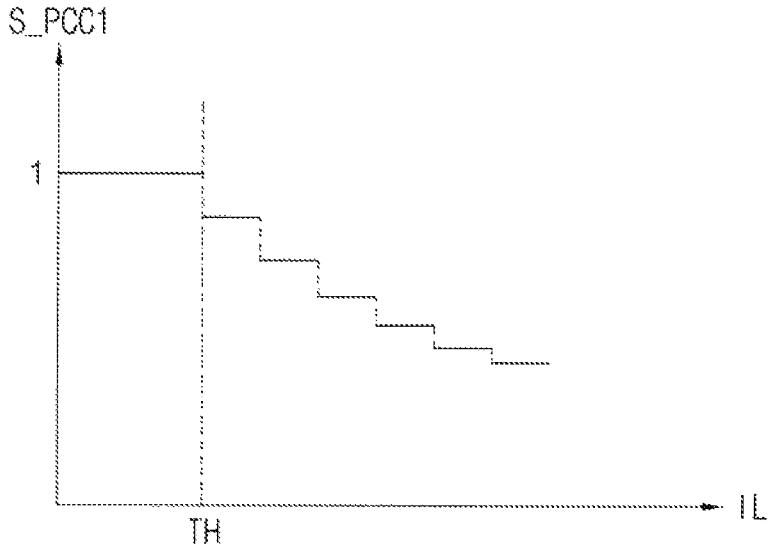
FIG. 9A is a graph illustrating an example of a sub-peak control coefficient determined by ambient light.
Figure 9B:
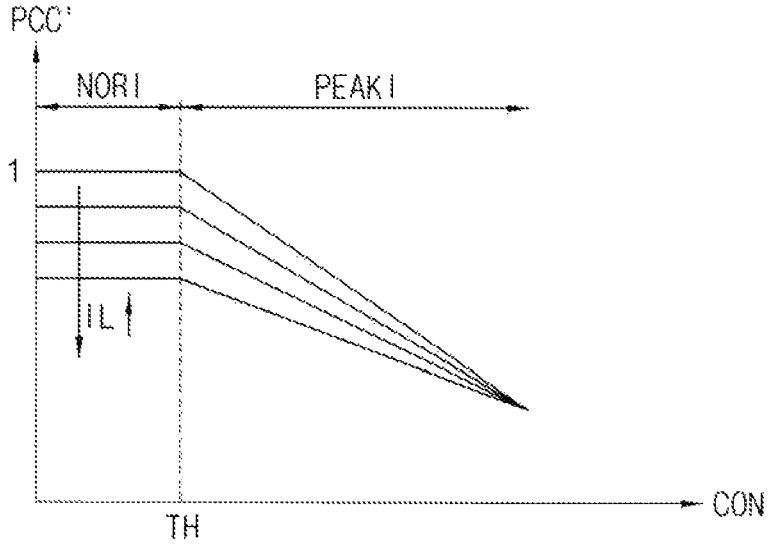
FIG. 9B is a graph illustrating an example of a peak control coefficient determined based on the sub-peak control coefficient of FIG. 9A.

FIG. 9A is a graph illustrating an example of a sub-peak control coefficient determined by ambient light. FIG. 9B is a graph illustrating an example of a corrected peak control coefficient determined based on the sub-peak control coefficient of FIG. 9A.

Referring to FIGS. 9A and 9B, the sub peak control coefficient S_PCC1 may be changed according to the ambient light IL and the corrected peak control coefficient PCC' may be changed according to the sub peak control coefficient S_PCC1.

In some embodiments, the peak control coefficient PCC may be determined to 1 when the ambient light IL is lower than or equal to a reference ambient light TH. In this, the ambient light IL may not affect the peak luminance. In some embodiments, the peak controller 750 may be disabled when the ambient light IL is lower than or equal to the reference ambient light TH.

As illustrated in FIG. 9A, the sub peak control coefficient S_PCC1 may decrease as a step function according to an increase of the ambient light IL when the ambient light IL is higher than the reference ambient light TH. Thus, as the ambient light IL increases, the peak luminance of the image may increase. The sub peak control coefficient S_PCC1 may be determined regardless whether the image is the normal image NORI or the peak image PEAKI.

FIG. 9B shows changes of relation between the corrected peak control coefficient PCC' and the contrast CON according to a change of the sub peak control coefficient S_PCC1. As illustrated in FIG. 9B, in the normal image NORI, as the ambient light increases, the corrected peak control coefficient PCC' may decrease and the peak luminance may increases. Similarly, in the peak image PEAKI having the same contrast CON, as the ambient light increases, the corrected peak control coefficient PCC' may decrease.

Accordingly, the peak luminance of the image may be adaptively controlled based on the load, contrast CON, and the ambient light IL. Thus, the visibility in the high-ambient light environment may be improved.

Figure 10:
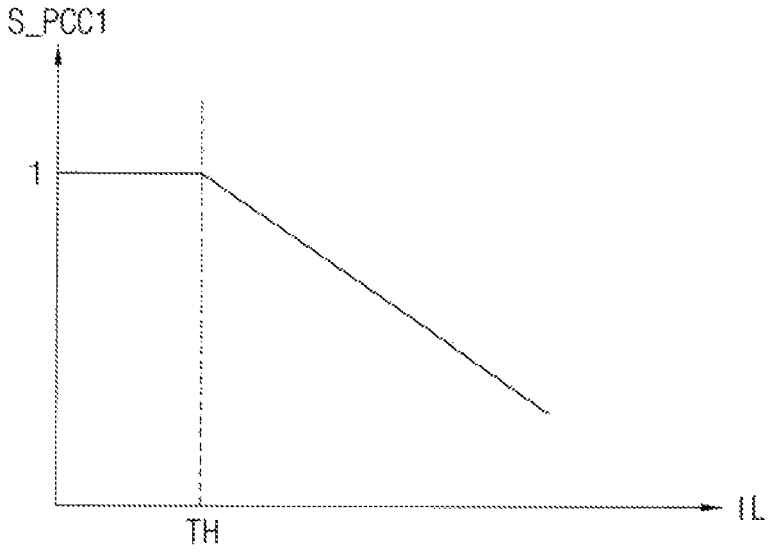
FIG. 10 is a graph illustrating another example of a sub-peak control coefficient determined by ambient light.

FIG. 10 is a graph illustrating another example of a sub-peak control coefficient determined by ambient light.

Referring to FIG. 10, the sub peak control coefficient S_PCC1 may be changed according to the ambient light IL.

In some embodiments, the sub peak control coefficient S_PCC1 may be determined to 1 when the ambient light IL is lower than or equal to a reference ambient light TH. In this, the ambient light IL may not influence on the peak luminance. In some embodiments, the peak controller 750 may not be operated when the ambient light IL is lower than or equal to the reference ambient light TH.

The sub peak control coefficient S_PCC1 may linearly decrease according to an increase of the ambient light IL when the ambient light IL is higher than the reference ambient light TH. Thus, as the ambient light IL increases, the peak luminance of the image may increase. The sub peak control coefficient S_PCC1 may be determined regardless whether the image is the normal image NORI or the peak image PEAKI.

However, this is an example, and forms of the decrease of the peak control coefficient S_PCC1 based on the ambient light IL are not limited thereto.

Figure 11:
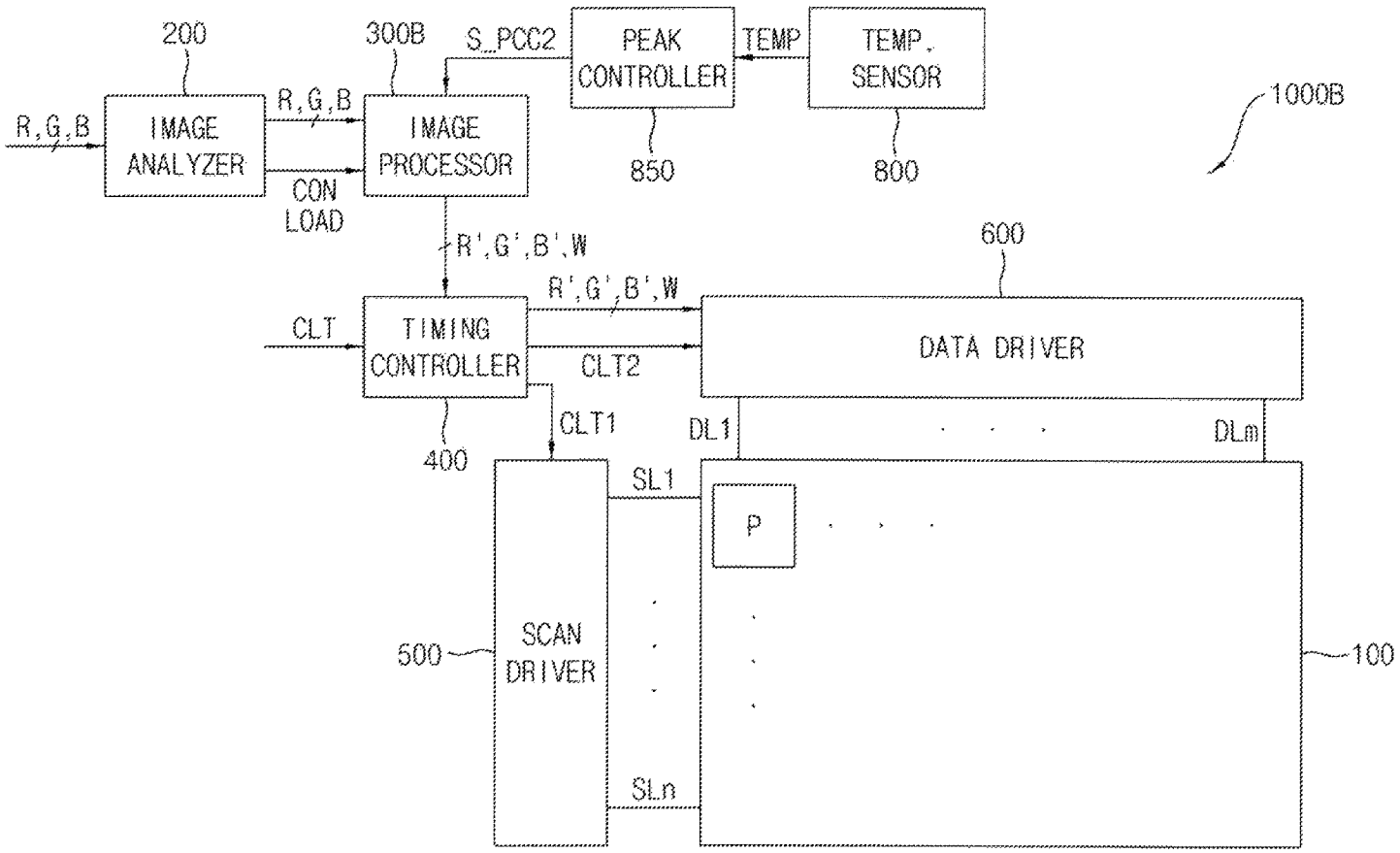
FIG. 11 is a block diagram of a display device according to example embodiments.

FIG. 11 is a block diagram of a display device according to example embodiments.

The display device of the present example embodiments are substantially the same as the display device explained with reference to FIGS. 1 through 7B except for constructions of a temperature sensor, a peak controller, and an image processor. Thus, the same reference numerals will be used to refer to the same or like parts as those described in the example embodiments of FIGS. 1 through 7B, and any repetitive explanation concerning the above elements will be omitted.

Referring to FIG. 11, the display device 1000B may include a display panel 100, an image analyzer 200, an image processor 300B, a timing controller 400, a scan driver 500, a data driver 600, a temperature sensor 800, and a peak controller 850.

The display panel 100 may include a plurality of pixels P each having a red sub pixel, a green sub pixel, a blue sub pixel, and a white sub pixel.

The image analyzer 200 may calculate contrast CON and load LOAD of an image of a frame based on R, G, and B image data R, G, B input corresponding to the frame. The image analyzer 200 may provide the R, G, and B image data R, B, the contrast CON and the load LOAD to the image processor 300B. The image analyzer 200 may determine the image of the frame as a normal image or a peak image.

The image processor 300B may control a peak control coefficient applied to W image data to adaptively control peak luminance based on the contrast CON and the load LOAD. The image processor 300B may receive a sub peak control coefficient S_PCC2 generated based on a temperature TEMP from the peak controller 850. The sub peak control coefficient S_PCC2 may be used to determine the peak control coefficient or the W image data W. In some embodiments, the peak control coefficient may be changed by the sub peak control coefficient S_PCC2. For example, the sub peak control coefficient S_PCC2 may be multiplied to the peak control coefficient to get a corrected peak control coefficient. The image processor 300B may convert the R, G, and B image data R, B into R', G', and B' image data R', G', B' based on the corrected peak control coefficient which is determined using the sub peak control coefficient S_PCC2. In some embodiments, the image processor 300B may adaptively control the peak luminance based on the contrast CON, the load LOAD, and the temperature TEMP of the display panel 100.

The temperature sensor 800 may detect the temperature TEMP of the display panel 100. The display device 1000B may increase the peak luminance to improve the visibility when the temperature TEMP of the display panel 100 is lower than a specific reference. The display device 1000B may decrease the peak luminance to reduce the deterioration of the mage quality when the temperature TEMP of the display panel 100 is relatively high. The temperature TEMP of the display panel 100 detected by the temperature sensor 800 may be additionally applied to the R, G, and B image data R, G, B to control the peak luminance.

The peak controller 850 may determine the sub peak control coefficient S_PCC2 according to the temperature TEMP. The peak controller 850 may provide the sub peak control coefficient S_PCC2 to the image processor 300B. In some embodiments, the peak controller 850 may only be operated when the temperature TEMP is lower than a predetermined reference temperature. The peak controller 850 may decrease the sub peak control coefficient S_PCC2 at a predetermined interval according to a decrease of the temperature TEMP. In the peak image, the corrected peak control coefficient may decrease according to the decrease of the temperature TEMP. Thus, the peak luminance may increase according to the decrease of the temperature TEMP. In some embodiments, when a temperature of the display panel 100 is higher than the reference temperature, the peak luminance control operations as described above with reference to FIGS. 1 through 7B may be performed.

The timing controller 400 may control the scan driver 500 and the data driver 600 according to a control signal CLT received from external devices. The scan driver 500 may provide a plurality of scan signals to the display panel 100. The data driver may convert the R', G', B', and W image data R', G', B', W or the data signal into an analog type data voltage based on a second control signal CLT2 received from the timing controller 400 and may apply the data voltage to the data lines DL1 through DLm.

As described above, the display device 1000B may adaptively control the peak luminance based on the contrast CON, the load LOAD, and the temperature TEMP of the display panel 100 every frame. Thus, the visibility, reality and immersion of the image may be improved. Further, the peak luminance may be controlled by an adaptive image data conversion based on the corrected peak control coefficient so that deterioration of the image quality may be reduced.

Figure 12A:
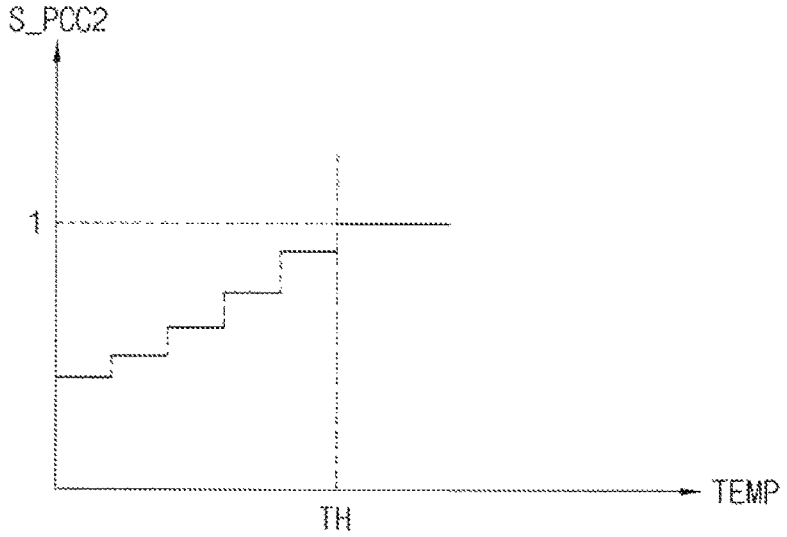
FIG. 12A is a graph illustrating an example of a sub-peak control coefficient determined by a temperature of a display panel.
Figure 12B:
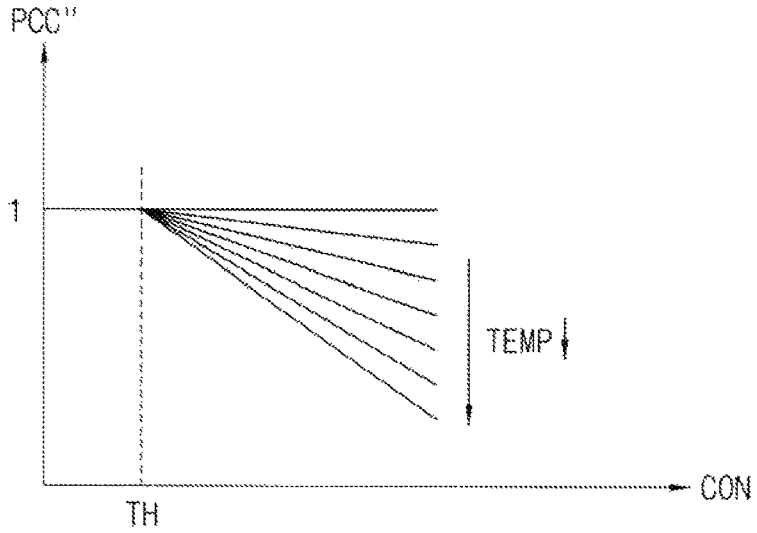
FIG. 12B is a graph illustrating an example of a peak control coefficient determined based on the sub-peak control coefficient of FIG. 12A.

FIG. 12A is a graph illustrating an example of a sub-peak control coefficient determined by a temperature of a display panel. FIG. 12B is a graph illustrating an example of a corrected peak control coefficient determined based on the sub-peak control coefficient of FIG. 12A.

Referring to FIGS. 11 through 12B, the sub peak control coefficient S_PCC2 may be changed according to the temperature TEMP of the display panel 100 and the corrected peak control coefficient PCC" may be changed according to the sub peak control coefficient S_PCC2.

In some embodiments, the peak controller 850 may be operated when the image of the frame is the peak image.

In some embodiments, the sub peak control coefficient S_PCC2 may be determined to 1 when the temperature TEMP is higher than or equal to a reference temperature TH. In this, the temperature TEMP may not influence on the peak luminance. In some embodiments, the peak controller 850 may not be operated when the temperature TEMP is higher than or equal to the reference temperature TH.

As illustrated in FIG. 12A, the sub peak control coefficient S_PCC2 may decrease as a step function according to a decrease of the temperature TEMP when the temperature TEMP of the display panel 100 is lower than the reference temperature TH. Thus, as the temperature TEMP decreases, the peak luminance of the image may increase.

FIG. 12B shows changes of relation between the corrected peak control coefficient PCC" and the contrast CON according to a change of the sub peak control coefficient S_PCC2. As illustrated in FIG. 12B, in the peak image PEAKI having the same contrast CON, as the temperature TEMP decreases, the corrected peak control coefficient PCC" may decrease and the peak luminance may increases.

Accordingly, the peak luminance of the image may be adaptively controlled based on the load, contrast CON, and the temperature TEMP. Thus, the visibility may be improved and the deterioration may be reduced.

Figure 13:
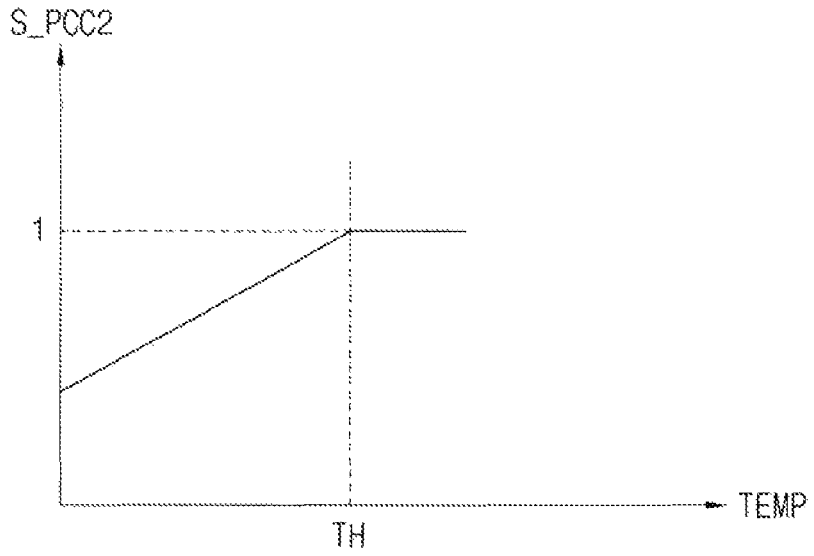
FIG. 13 is a graph illustrating another example of a sub-peak control coefficient determined by a temperature of a display panel.

FIG. 13 is a graph illustrating another example of a sub-peak control coefficient determined by a temperature of a display panel.

Referring to FIG. 13, the sub peak control coefficient S_PCC2 may be changed according to the temperature TEMP.

In some embodiments, the sub peak control coefficient S_PCC2 may be additionally multiplied to the peak control coefficient to get a corrected peak control coefficient PCC". Accordingly, the W image data may be multiplied by the sub peak control coefficient S_PCC2 and the peak control coefficient to get a corrected peak control coefficient PCC".

In some embodiments, the sub peak control coefficient S_PCC2 may be determined to 1 when the temperature TEMP is higher than or equal to a reference temperature TH. In this, the temperature TEMP may not influence on the peak luminance. In some embodiments, the peak controller 850 may not be operated when the temperature TEMP is higher than or equal to the reference temperature TH.

The sub peak control coefficient S_PCC2 may linearly decrease according to a decrease of the temperature TEMP when the temperature is lower than the reference temperature TH. Thus, as the temperature TEMP decreases, the peak luminance of the image may increase. However, this is an example, and forms of the decrease of the peak control coefficient S_PCC2 based on the temperature TEMP are not limited thereto.

Figure 14:
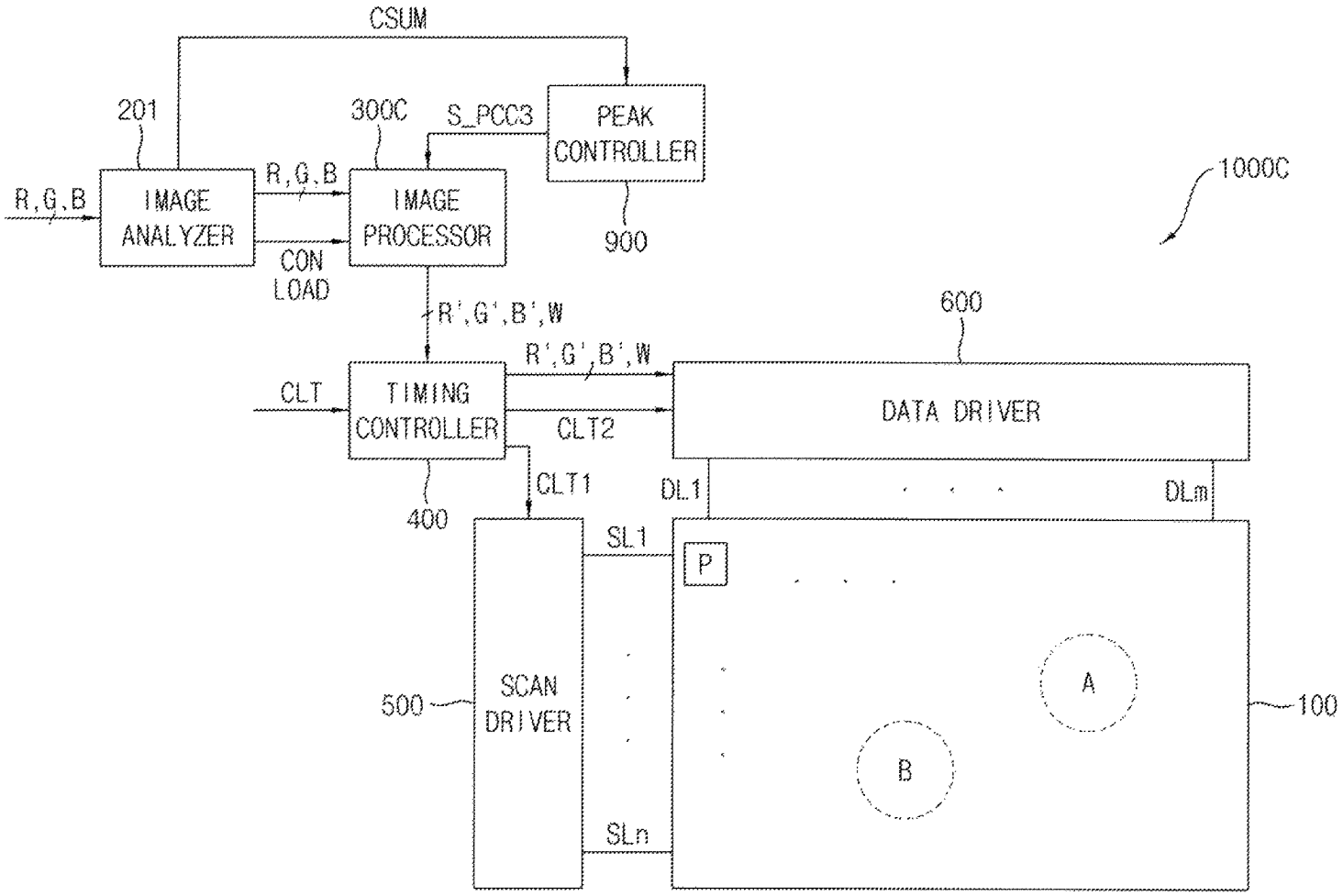
FIG. 14 is a block diagram of a display device according to example embodiments.

FIG. 14 is a block diagram of a display device according to example embodiments.

The display device of the present example embodiments are substantially the same as the display device explained with reference to FIGS. 1 through 7B except for constructions of an image analyzer, a peak controller, and an image processor. Thus, the same reference numerals will be used to refer to the same or like parts as those described in the example embodiments of FIGS. 1 through 7B, and any repetitive explanation concerning the above elements will be omitted.

Referring to FIG. 14, the display device 1000C may include a display panel 100, an image analyzer 201, an image processor 300C, a timing controller 400, a scan driver 500, a data driver 600, and a peak controller 900.

The display panel 100 may include a plurality of pixels P each having a red sub pixel, a green sub pixel, a blue sub pixel, and a white sub pixel. An image displayed on the display panel 100 may have areas having a large difference in saturation (or chroma). For example, an achromatic color image such as a white image, etc may be displayed at a first area A and a primary color image such as a red image, etc may be displayed at a second area B. There is a large difference of the saturation between the first and second areas A and B. Here, when the entire image of the display panel 100 emit light with a high luminance, a color shift may be seen and the visual discomfort may occur.

The image analyzer 201 may calculate contrast CON and load LOAD of an image of a frame based on R, G, and B image data R, G, B input corresponding to the frame. The image analyzer 201 may provide the R, G, and B image data R, G, B the contrast CON and the load LOAD to the image processor 300C. The image analyzer 201 may determine the image of the frame as a normal image or a peak image.

In some embodiments, the image analyzer 201 may further calculate a total sum of saturation CSUM of the entire image based on the R, G, and B image data R, G, B when the image of the frame is the peak image. For example, a saturation of a specific pixel may be calculated by Equation 4 and the total sum of saturation CSUM may be calculated by Equation 5.

$$C(x, y) = \max(R, G, B) - \min(R, G, B) \quad \text{Equation 4}$$

$$CSUM = \sum_{x,y=(1,1)}^{(N,M)} C(x, y) \quad \text{Equation 5}$$

In Equation 4 and Equation 5, C(x, y) represents a saturation of a pixel corresponding to an (x, y) coordinate of the display panel 100, max(R, G, B) represents a maximum value among the R, G; and B image data R, B, min(R, G, B) represents a minimum value among the R, G, and B image data R, G, B, and CSUM represents the total sum of saturation. (1, 1) may represent a leftmost and uppermost coordinate of pixel in the display panel 100, N represents the number of pixel columns, and M represents the number of pixel rows. Referring to Equation 5, as the difference of saturation (or chroma) increases, the total sum of saturation CSUM may increase.

The image processor 300C may control a peak control coefficient applied to W image data to adaptively control peak luminance based on the contrast CON and the load LOAD. The image processor 300C may receive a sub peak control coefficient S_PCC3 generated based on the total sum of saturation CSUM from the peak controller 900. The sub peak control coefficient S_PCC3 may be applied to the peak control coefficient or the W image data W. In some embodiments, the peak control coefficient may be affected by the sub peak control coefficient S_PCC3. For example, the sub peak control coefficient S_PCC3 may be multiplied to the peak control coefficient to get a corrected peak control coefficient. The image processor 300C may convert the R, G, and B image data R, G, B into R', G', and B' image data R', G', B' based on the corrected peak control coefficient. In some embodiments, the image processor 300C may adaptively control the peak luminance based on the contrast CON, the load LOAD, and the total sum of saturation CSUM.

The peak controller 900 may compare the total sum of saturation CSUM with a predetermined reference and determine the sub peak control coefficient S_PCC3. The sub peak control coefficient S_PCC3 may be additionally applied to the W image data W. The peak controller 900 may provide the sub peak control coefficient S_PCC3 to the image processor 300C. In some embodiments, the peak controller 900 may be operated when the total sum of saturation CSUM is lower than the reference value. The peak controller 900 may decrease the sub peak control coefficient S_PCC3 at a predetermined interval according to a decrease of the total sum of saturation CSUM. Accordingly, the corrected peak control coefficient may increase according to an increase of total sum of saturation CSUM. Thus, the peak luminance may decrease according to the increase of the total sum of saturation CSUM. Thus, the color shift in the image having a large difference of saturation may be prevented and the visibility may be improved.

In some embodiments, the peak controller 900 may be included in the image processor 300C.

In some embodiments, when the total sum of saturation CSUM is greater than or equal to the reference, the peak luminance control operations as described above with reference to FIGS. 1 through 7B may be performed.

As described above, the display device 1000C may adaptively control the peak luminance based on the contrast CON, the load LOAD, and the total sum of saturation CSUM of the display panel 100 every frame. Thus, the visibility, reality and immersion of the image may be improved and the color shift in the image having the large difference of saturation may be prevented. Further, the peak luminance may be controlled by an adaptive image data conversion based on the corrected peak control coefficient so that deterioration of the image quality may be reduced.

Figure 15:
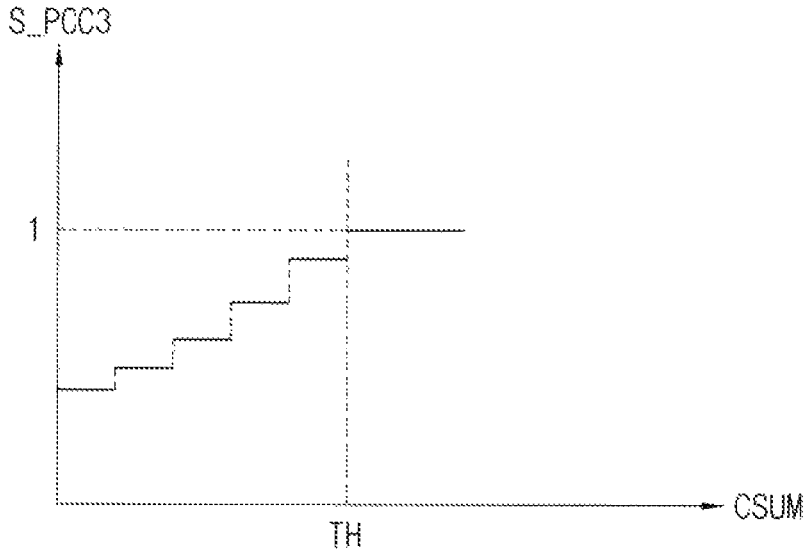
FIG. 15 is a graph illustrating another example of a sub-peak control coefficient determined by saturation of an image.

FIG. 15 is a graph illustrating another example of a sub-peak control coefficient determined by saturation of an image.

Referring to FIGS. 14 and 15, the sub peak control coefficient S_PCC3 may change based on the total sum of saturation CSUM.

In some embodiments, the peak control coefficient S_PCC3 may be additionally multiplied to the peak control coefficient. Accordingly, the W image data may be multiplied by the sub peak control coefficient S_PCC3 and the peak control coefficient.

In some embodiments, the sub peak control coefficient S_PCC3 may be determined to 1 when the total sum of saturation CSUM is higher than or equal to a third reference TH. In this, the total sum of saturation CSUM may not influence on the peak luminance. In some embodiments, the peak controller 900 may not operate when the total sum of saturation CSUM is higher than or equal to the third reference TH.

As illustrated in FIG. 15, the sub peak control coefficient S_PCC3 may decrease as a step function according to a decrease of the total sum of saturation CSUM when the total sum of saturation CSUM is lower than the third reference TH. In some embodiments, the sub peak control coefficient S_PCC3 may have a uniform positive real number less than 1 when the total sum of saturation CSUM is lower than the third reference TH.

Accordingly, the peak luminance may be adaptively controlled based on the load, the contrast, and the total sum of saturation CSUM. Thus, the visibility may be improved and the deterioration may be reduced.

Figure 16:
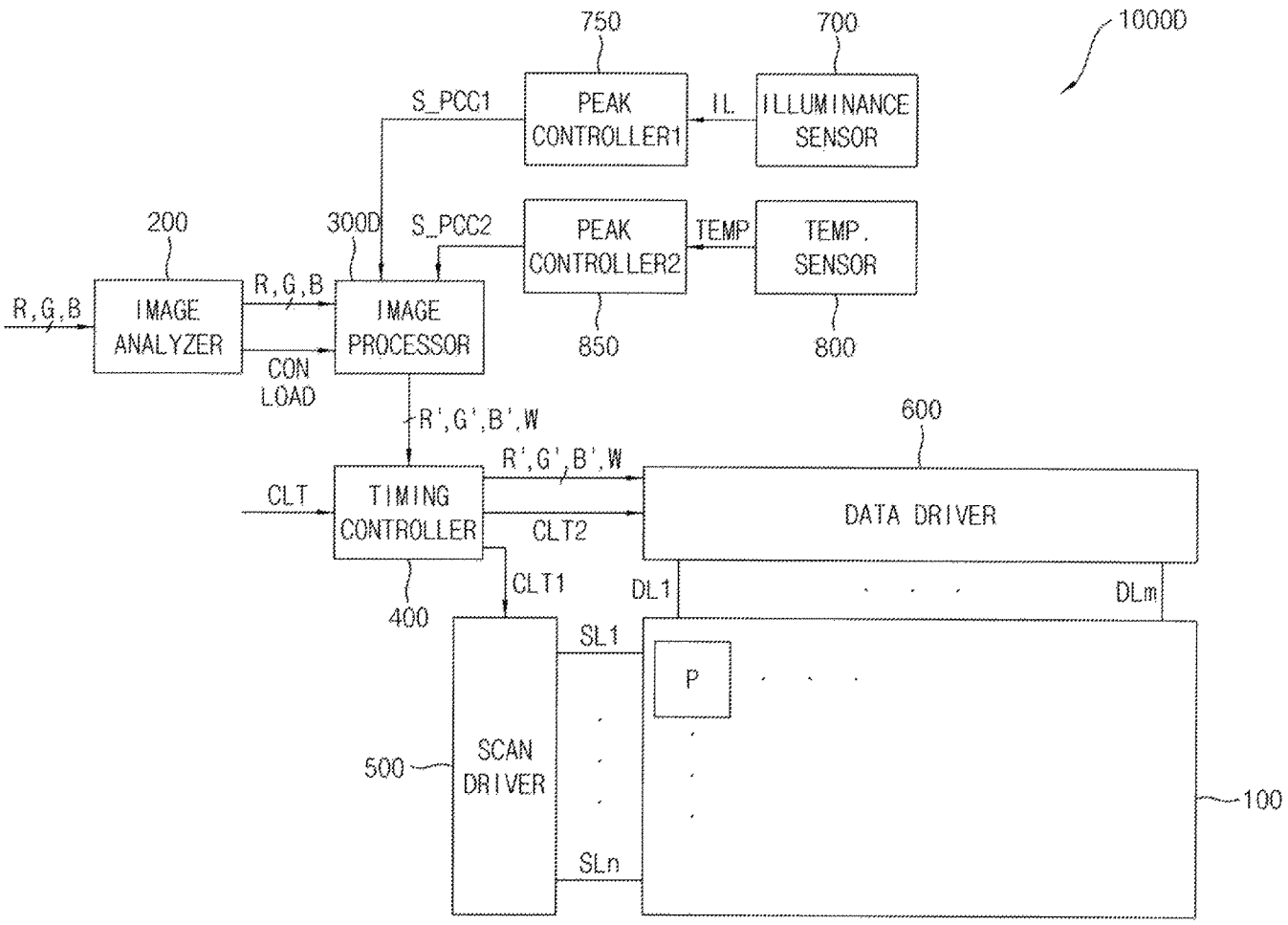
FIG. 16 is a block diagram of a display device according to example embodiments.

FIG. 16 is a block diagram of a display device according to example embodiments.

The display device of the present example embodiments are substantially the same as the display device explained with reference to FIGS. 1 through 7B except for constructions of a temperature sensor, a illuminance sensor, a first peak controller, a second peak controller, and an image processor. Thus, the same reference numerals will be used to refer to the same or like parts as those described in the example embodiments of FIGS. 1 through 13, and any repetitive explanation concerning the above elements will be omitted.

Referring to FIG. 16, the display device 1000D may include a display panel 100, an image analyzer 200, an image processor 300D, a timing controller 400, a scan driver 500, a data driver 600, an illuminance sensor 700, a first peak controller 750, a temperature sensor 800, and a second peak controller 850.

The display panel 100 may include a plurality of pixels P each having a red sub pixel, a green sub pixel, a blue sub pixel, and a white sub pixel.

The image analyzer 200 may calculate contrast CON and load LOAD of an image of a frame based on R, G, and B image data R, G, B input corresponding to the frame. The image analyzer 200 may provide the R, G, and B image data R, B, the contrast CON and the load LOAD to the image processor 300B. The image analyzer 200 may determine the image of the frame as a normal image or a peak image.

The image processor 300D may control a peak control coefficient applied to W image data to adaptively control peak luminance based on the contrast CON and the load LOAD. The image processor 300D may receive a first sub peak control coefficient S_PCC1 generated based on an ambient light IL from the first peak controller 750. The image processor 300D may receive a second sub peak control coefficient S_PCC2 generated based on a temperature TEMP from the second peak controller 850. The image processor 300D may adaptively control the peak luminance based on the contrast CON, the load LOAD, the ambient light IL, and the temperature TEMP of the display panel 100.

The first peak controller 750 may determine the first sub peak control coefficient S_PCC1 based on the ambient light IL. The first peak controller 750 may provide the first sub peak control coefficient S_PCC1 to the image processor 300D. The second peak controller 850 may determine the second sub peak control coefficient S_PCC2 based on the temperature TEMP. The second peak controller 850 may provide the second sub peak control coefficient S_PCC2 to the image processor 300D.

In some embodiments, the first sub peak control coefficient S_PCC1 and the second sub peak control coefficient S_PCC2 may be additionally multiplied to the peak control coefficient to get a corrected peak control coefficient. Accordingly, the W image data may be multiplied by the first and second sub peak control coefficients S_PCC1 and S_PCC2 and the peak control coefficient to get a corrected peak control coefficient.

Since the illuminance sensor 700 and the first peak controller 750 are described above referred to FIGS. 8 through 10 and the temperature sensor 800 and the second peak controller 850 are described above referred to FIGS. 11 through 13, duplicate descriptions will not be repeated.

As described above, the display device 1000D may adaptively control the peak luminance based on the contrast CON, the load LOAD, the ambient light IL, and the temperature TEMP every frame. Thus, the visibility, reality and immersion of the image may be improved. Further, the peak luminance may be controlled by an adaptive image data conversion based on the corrected peak control coefficient so that deterioration of the image quality may be reduced.

Figure 17:
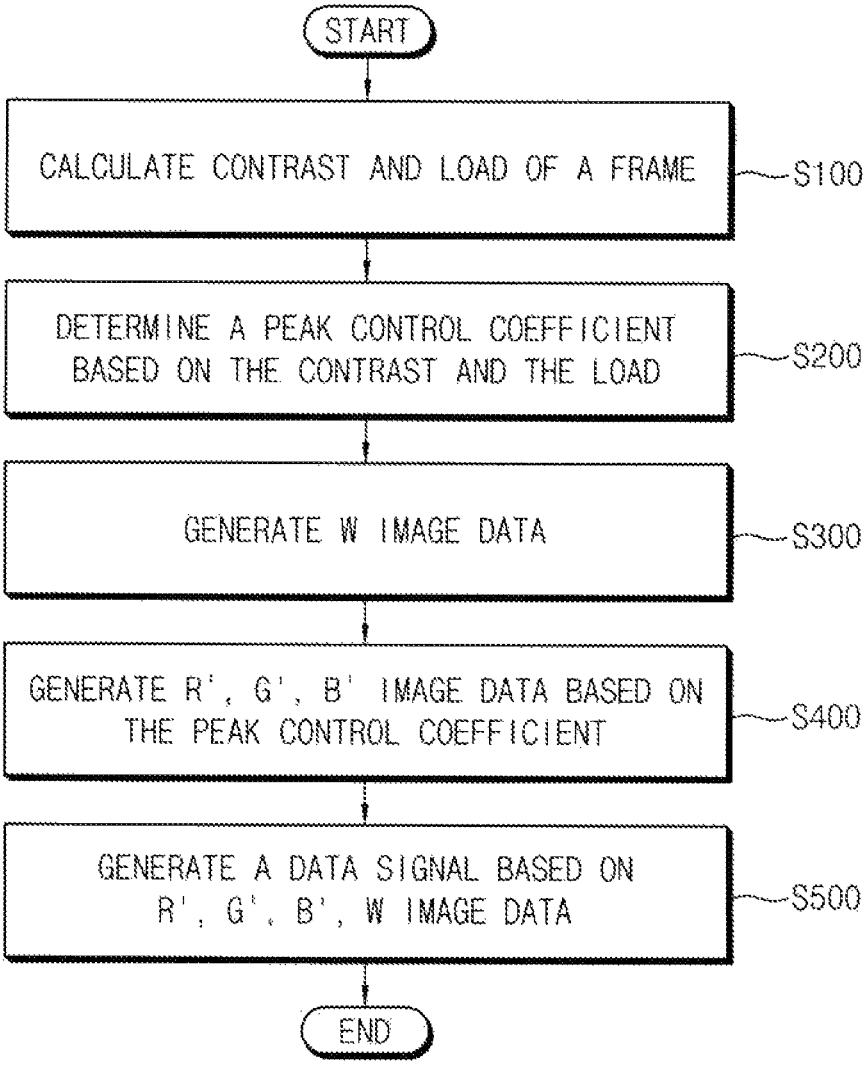
FIG. 17 is a flow chart of a method for controlling peak luminance of a display device according to example embodiments.

FIG. 17 is a flow chart of a method for controlling peak luminance of a display device according to example embodiments.

Referring to FIG. 17, the method for controlling peak luminance of the display device may include calculating contrast and load of an image of a frame based on R, G, and B image data input corresponding to the frame S100, determining a peak control coefficient for adaptively controlling peak luminance based on the contrast and the load S200, generating W image data based on a minimum value among grayscales of the R, G, and B image data S300, generating R', G', and B' image data by subtracting a product of the W image data and the peak control coefficient from the R, G, and B image data, respectively S400, and generating a data signal based on the R', G', B', and W image data S500.

In some embodiments, the peak luminance increases when the peak control coefficient decreases. The peak luminance may be adaptively controlled based on at least one of an ambient light surrounding the display panel, a temperature of the display panel, and a total sum of saturation of the image of the frame.

Since the methods for controlling peak luminance of the display device are described above referred to FIGS. 1 through 16, duplicate descriptions will not be repeated.

Figure 18:
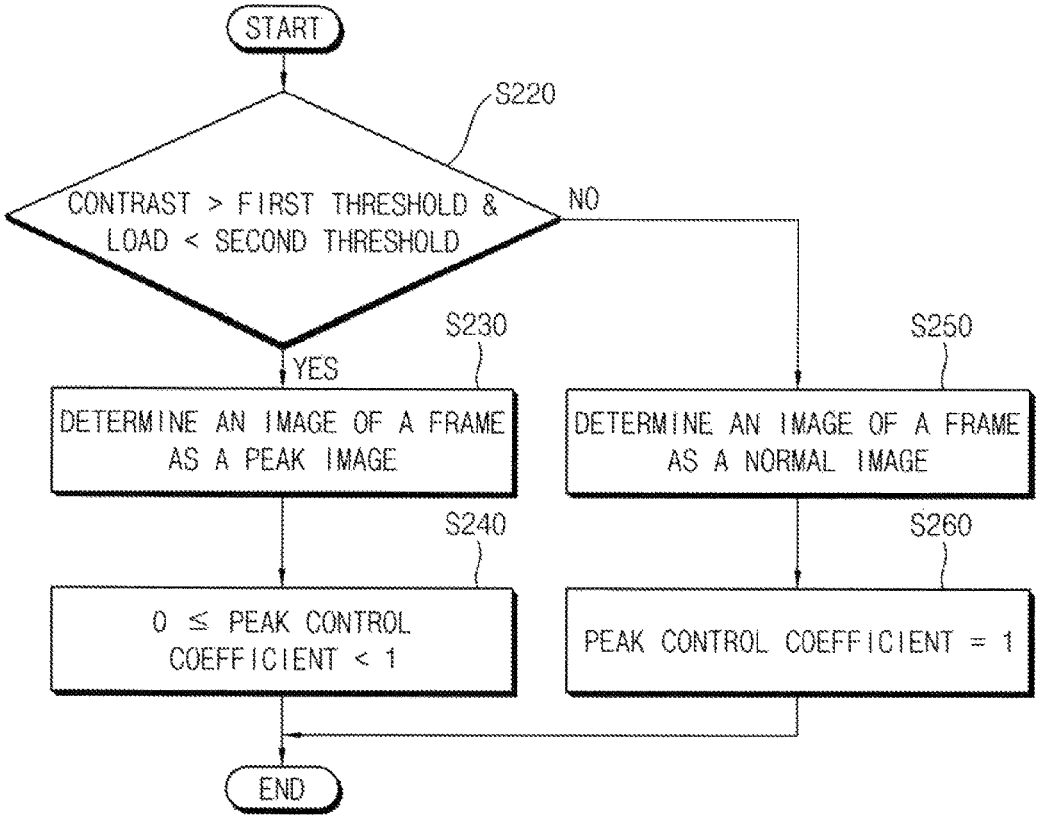
FIG. 18 is a flow chart illustrating an example of determining a peak control coefficient of the method of FIG. 17.

FIG. 18 is a flow chart illustrating an example of determining a peak control coefficient of the method of FIG. 17.

Referring to FIG. 18, determining the peak control coefficient S200 may include comparing the contrast with a predetermined first reference and comparing the load with a predetermined second reference S220, and determining the peak control coefficient S240 and S260.

In some embodiments, the image of the frame may be determined as a peak image which requires an increase of the peak luminance when the contrast is greater than the first reference and the load is less than the second reference S230. The peak control coefficient may be determined to a real number within a range greater than or equal to 0 and less than 1 based on the contrast when the image of the frame is the peak image S240.

In some embodiments, the image of the frame may be determined as a normal image when at least one situation that the contrast is less than the first reference and the load is greater than the second reference S250. The peak control coefficient may be determined to 1 when the image of the frame is the normal image S260.

Since the methods for controlling peak luminance of the display device are described above referred to FIGS. 1 through 16, duplicate descriptions will not be repeated.

Accordingly, the method for controlling peak luminance of the display device may adaptively control the peak luminance of the image based on the contrast, the load, and so on, every frame. Thus, the visibility, reality and immersion of the image may be improved. Further, the peak luminance may be controlled by an adaptive image data conversion based on the peak control coefficient so that deterioration of the image quality may be reduced.

Figure 19:
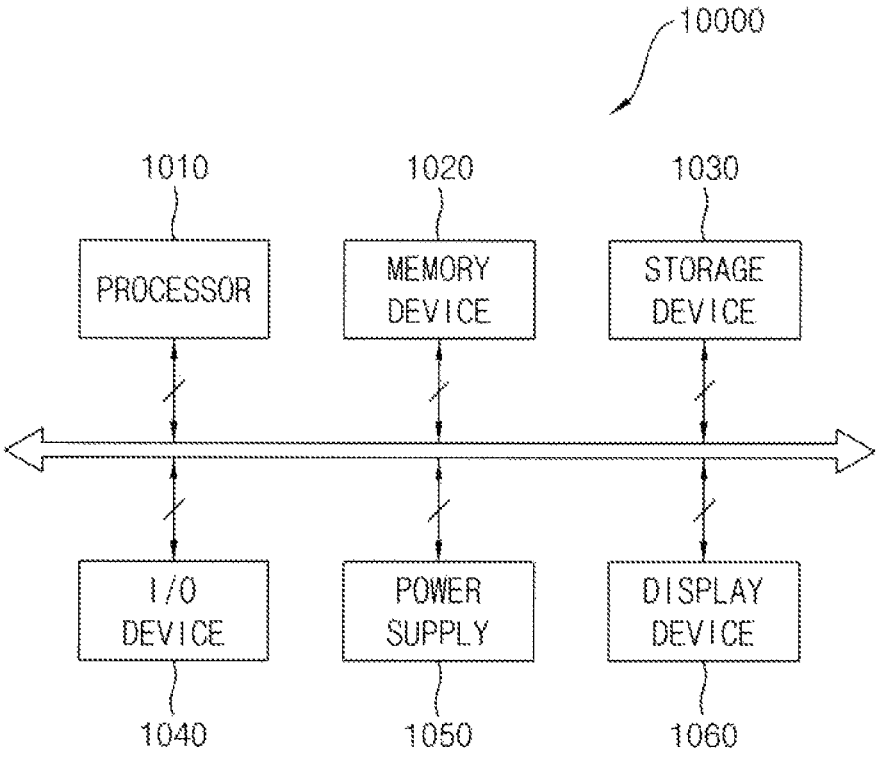
FIG. 19 is a block diagram of an electronic device according to example embodiments.
Figure 20A:
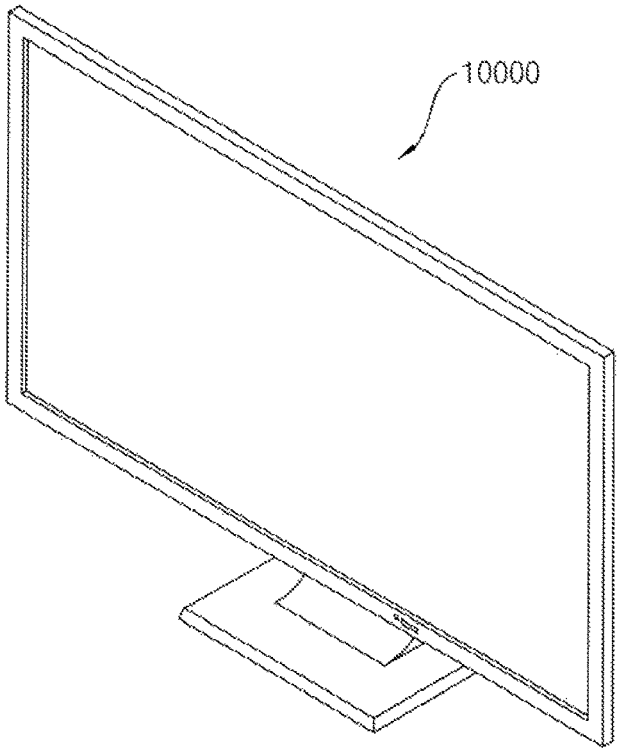
FIG. 20A is a diagram illustrating an example of the electronic device of FIG. 19 implemented as a television.
Figure 20B:
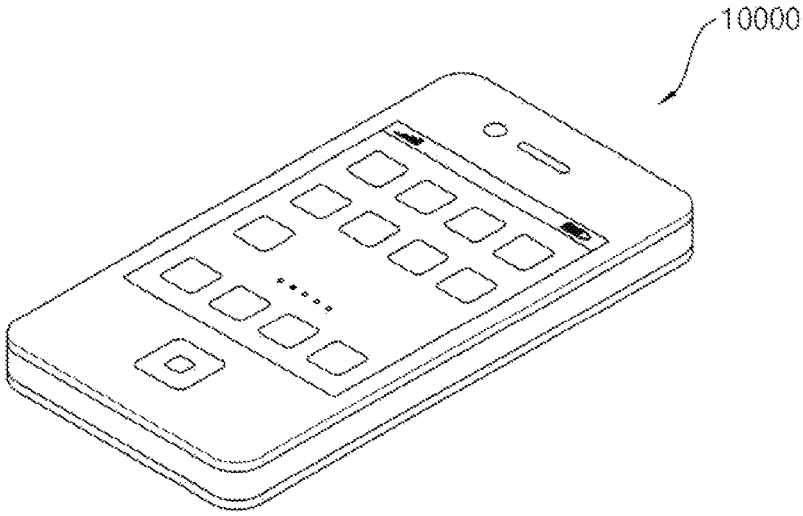
FIG. 20B is a diagram illustrating an example of the electronic device of FIG. 19 implemented as a smart phone.

FIG. 19 is a block diagram of an electronic device according to example embodiments. FIG. 20A is a diagram illustrating an example of the electronic device of FIG. 19 implemented as a television. FIG. 20B is a diagram illustrating an example of the electronic device of FIG. 19 implemented as a smart phone.

Referring to FIGS. 19 through 20B, the electronic device 10000 may include a processor 1010, a memory device 1020, a storage device 1030, an input/output (I/O) device 1040, a power supply 1050, and a display device 1060. Here, the display device 1060 may correspond to one of the display devices of FIGS. 1 through 16. In addition, the electronic device 10000 may further include a plurality of ports for communicating with a video card, a sound card, a memory card, a universal serial bus (USB) device, other suitable electronic devices, etc. In one embodiment, as illustrated in FIG. 20A, the electronic device 10000 may be implemented in a television. In one embodiment, as illustrated in FIG. 20B, the electronic device 10000 may be implemented in a smart phone. However, these are examples and the electronic device 10000 is not limited thereto. For example, the electronic device 10000 may be implemented in a cellular phone, a video phone, a smart pad, a smart watch, a tablet, a personal computer, a navigation for vehicle, a monitor, a notebook, a head mounted display (HMD), and/or the like.

The processor 1010 may perform various suitable computing functions. The processor 1010 may be a microprocessor, a central processing unit (CPU), etc. The processor 1010 may be coupled to other suitable components via an address bus, a control bus, a data bus, etc. Furthermore, the processor 1010 may be coupled to an extended bus such as a peripheral component interconnection (PCI) bus.

The memory device 1020 may also store data for operations of the electronic device 10000. For example, the memory device 1020 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device, such as a dynamic random access memory (DRAM) device, a static random access memory (SRAM) device, a mobile DRAM device, and/or the like.

The storage device 1030 may store data for operations of the electronic device 10000. The storage device 1030 may be a solid state drive (SSD) device, a hard disk drive (HDD) device, a CD-ROM device, and/or the like.

The I/O device 1040 may be an input device, such as a keyboard, a keypad, a touchpad, a touch-screen, a mouse, and/or the like, and an output device, such as a printer, a speaker, and/or the like.

The power supply 1050 may provide power for operating the electronic device 1000.

The display device 1060 may be connected to other elements via the buses or other communication links. According to some example embodiments, the display device 1060 may be included in the I/O device 1040. As described above, the display device 1060 may adaptively control peak luminance of every frame based on a contrast and a load of an image of the frame. The display device may include an image analyzer configured to calculate the contrast and the load of the image of the frame based on R, G, and B image data input corresponding to the frame, an image processor configured to control a peak control coefficient applied to W image data to adaptively control peak luminance based on the contrast and the load, and to respectively generate R', G', and B' image data by subtracting a product of the W image data and the peak control coefficient from each of the R, G, and B image data, a display panel including a plurality of pixels, a data driver configured to generate a data signal based on the R', G', B, and W image data, and to provide the data signal to the display panel, and a scan driver configured to provide a scan signal to the display panel.

As described above, in the electronic device 10000 including the display device 1060, the visibility, reality and immersion of the image may be improved.

The present embodiments may be applied to any display device and any system including the display device having white sub pixels. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A display device, comprising:

an image analyzer configured to calculate contrast and load of an image of a frame based on R, G, and B image data input corresponding to the frame;

an image processor configured to control a peak control coefficient applied to W image data to adaptively control peak luminance based on the contrast and the load, and to respectively generate R', G', and B' image data by subtracting a product of the W image data and the peak control coefficient from each of the R, G, and B image data;

a display panel including a plurality of pixels;

a data driver configured to generate a data signal based on the R', G', B, and W image data, and to provide the data signal to the display panel; and a scan driver configured to provide a scan signal to the display panel, wherein the contrast is a proportion of a number of pixels having a low-grayscale range which have grayscales lower than a first predetermined gray scale to a number of pixels having a high-grayscale range which have grayscales higher than a second predetermined gray scale in one frame and the load is a proportion of an average signal level of the present frame to a signal level of a full-white image.

2. The display device of claim 1, wherein the peak luminance increases when the peak control coefficient decreases.

3. The display device of claim 1, wherein the image analyzer determines the image of the frame as a normal image when the contrast is less than a predetermined first reference or the load is greater than a predetermined second reference; and wherein the image analyzer determines the image of the frame as a peak image which requires an increase of the peak luminance when the contrast is greater than the first reference and the load is less than the second reference.

4. The display device of claim 3, wherein the image analyzer comprises:

a calculator configured to calculate the contrast and the load based on a histogram of the R, G, and B image data; and a comparator configured to compare the contrast with the first reference and to compare the load with the second reference.

5. The display device of claim 3, wherein the image processor comprises:

a coefficient determiner configured to determine the peak control coefficient corresponding to the contrast; and a data converter configured to generate the W image data based on a minimum value among grayscales of the respective R, G, and B image data, and to generate the R', G', and B' image data by subtracting the product of the W image data and the peak control coefficient from the respective R, G, and B image data.

6. The display device of claim 5, wherein the coefficient determiner determines the peak control coefficient to 1 when the image of the frame is the normal image, and wherein the coefficient determiner determines the peak control coefficient to a real number within a range greater than or equal to 0 and less than 1 based on the contrast when the image of the frame is the peak image.

7. The display device of claim 6, wherein the peak control coefficient has a uniform value regardless of the contrast when the image of the frame is the peak image.

8. The display device of claim 6, wherein the peak control coefficient decreases as a step function according to an increase of the contrast when the image of the frame is the peak image.

9. The display device of claim 6, wherein the peak control coefficient decreases linearly according to an increase of the contrast when the image of the frame is the peak image.

10. The display device of claim 6, wherein the peak control coefficient decreases as a step function according to an increase of a grayscale level when the image of the frame is the peak image.

11. The display device of claim 10, wherein a first peak luminance corresponding to a first grayscale range is less than a second peak luminance corresponding to a second grayscale range that has grayscales higher than grayscale levels within the first grayscale range.

12. The display device of claim 5, wherein the data converter comprises:

a minimum value selector configured to generate the W image data by selecting the minimum value among the grayscales of the R, G, and B image data;

a coefficient applier configured to generate W' image data by multiply the W image data by the peak control coefficient; and a subtractor configured to subtract the W' image data from each of the R, G, and B image data to generate the R', G', and B' image data, respectively.

13. The display device of claim 5, wherein peak control coefficients applied to the respective R, G, and B image data are the same each other.

14. The display device of claim 5, wherein at least one of peak control coefficients applied to the respective R, G, and B image data is different.

15. The display device of claim 3, wherein the image analyzer determines whether or not an image displayed on a predetermined pixel block is the peak image, and wherein the peak control coefficient is independently calculated per the predetermined pixel block.

16. The display device of claim 3, further comprising:

an illuminance sensor configured to detect ambient light around the display panel; and a peak controller configured to determine a sub peak control coefficient based on the ambient light and to provide the sub peak control coefficient to the image processor, the sub peak control coefficient being additionally applied to the W image data.

17. The display device of claim 16, wherein the peak controller decreases the sub peak control coefficient at a predetermined interval according to an increase of the ambient light, when the ambient light is greater than a predetermined reference ambient light, and wherein the image processor generate R', G', and B' image data by subtracting a product of the W image data, the peak control coefficient and the sub peak control coefficient from each of the R, G, and B image data.

18. The display device of claim 3, further comprising:

a temperature sensor configured to detect a temperature of the display panel; and a peak controller configured to determine a sub peak control coefficient based on the temperature and to provide the sub peak control coefficient to the image processor, the sub peak control coefficient being additionally applied to the W image data.

19. The display device of claim 18, wherein the peak controller decreases the sub peak control coefficient at a predetermined interval according to a decrease of the temperature, when the temperature is less than a predetermined reference temperature, and wherein the image processor generate R', G', and B' image data by subtracting a product of the W image data, the peak control coefficient and the sub peak control coefficient from each of the R, G, and B image data.

20. The display device of claim 3, wherein the image analyzer further calculates a total sum of saturation of the image based on the R, G, and B image data when the image of the frame is the peak image.

21. The display device of claim 20, further comprising:

a peak controller configured to compare the total sum of saturation with a predetermined third reference, to determine a sub peak control coefficient and to provide the sub peak control coefficient to the image processor, the sub peak control coefficient being additionally applied to the W image data.

22. The display device of claim 21, wherein the peak controller decreases the sub peak control coefficient at a predetermined interval according to a decrease of the total sum of saturation, when the total sum of saturation is less than the third reference, and wherein the image processor generate R', G', and B' image data by subtracting a product of the W image data, the peak control coefficient and the sub peak control coefficient from each of the R, G, and B image data.

23. A method for controlling peak luminance of a display device, the method comprising:

calculating contrast and load of an image of a frame based on R, G, and B image data input corresponding to the frame;

determining a peak control coefficient for adaptively controlling peak luminance based on the contrast and the load;

generating W image data based on a minimum value among grayscales of the R, G, and B image data;

generating R', G', and B' image data by subtracting a product of the W image data and the peak control coefficient from the R, G, and B image data, respectively; and generating a data signal based on the R', G', B', and W image data, wherein the contrast is a proportion of a number of pixels having a low-grayscale range which have grayscales lower than a first predetermined gray scale to a number of pixels having a high-grayscale range which have grayscales higher than a second predetermined gray scale in one frame and the load is a proportion of an average signal level of the present frame to a signal level of a full-white image.

24. The method of claim 23, wherein the peak luminance increases when the peak control coefficient decreases.

25. The method of claim 23, wherein determining the peak control coefficient comprises:

determining the image of the frame as a normal image when the contrast is less than a predetermined first reference or the load is greater than a predetermined second reference; and determining the peak control coefficient to 1 when the image of the frame is the normal image.

26. The method of claim 25, wherein determining the peak control coefficient further comprises:

determining the image of the frame as a peak image which requires an increase of the peak luminance when the contrast is greater than the first reference and the load is less than the second reference; and determining the peak control coefficient to a real number within a range greater than or equal to 0 and less than 1 based on the contrast when the image of the frame is the peak image.

27. The method of claim 26, wherein the peak control coefficient has a uniform value regardless of the contrast or decreases as a step function according to an increase of the contrast, when the image of the frame is the peak image.

28. A display device, comprising:

an image analyzer configured to calculate contrast and load of an image of a frame based on R, G, and B image data input corresponding to the frame;

an image processor configured to control a peak control coefficient applied to W image data to adaptively control peak luminance based on the contrast and the load, and to respectively convert the R, G, and B image data into R', G', B', and W image data based on the peak control coefficient;

an illuminance sensor configured to detect ambient light around the display panel;

a first peak controller configured to determine a first sub peak control coefficient based on the ambient light and to provide the sub peak control coefficient to the image processor, the first sub peak control coefficient being additionally applied to the W image data;

a temperature sensor configured to detect a temperature of the display panel;

a second peak controller configured to determine a second sub peak control coefficient based on the temperature and to provide the sub peak control coefficient to the image processor, the second sub peak control coefficient being additionally applied to the W image data;

a display panel including a plurality of pixels;

a data driver configured to generate a data signal based on the R', G', B, and W image data, and to provide the data signal to the display panel; and a scan driver configured to provide a scan signal to the display panel, wherein the contrast is a proportion of a number of pixels having a low-grayscale range which have grayscales lower than a first predetermined gray scale to a number of pixels having a high-grayscale range which have grayscales higher than a second predetermined gray scale in one frame and the load is a proportion of an average signal level of the present frame to a signal level of a full-white image.

29. The display device of claim 28, wherein the image analyzer determines the image of the frame as a normal image when the contrast is less than a predetermined first reference and the load is greater than a predetermined second reference; and wherein the image analyzer determines the image of the frame as a peak image which requires an increase of the peak luminance when the contrast is greater than the first reference and the load is less than the second reference.

30. A display device, comprising:

an image analyzer configured to decide a frame image characteristic, wherein the frame image characteristic includes a peak image which requires an increase of the peak luminance and a normal image, and is decided according to contrast and load of a frame image which is generated based on R, G, and B image data input of a frame, wherein the contrast is a proportion of a number of pixels having a low-grayscale range which have grayscales lower than a first predetermined gray scale to a number of pixels having a high-grayscale range which have grayscales higher than a second predetermined gray scale in one frame and the load is a proportion of an average signal level of the present frame to a signal level of a full-white image;

an image processor configured to receive the contrast and the frame image characteristic from the image analyzer and generate R', G', B', and W image data;

a display panel including a plurality of pixels;

a data driver configured to generate a data signal based on the R', G', B, and W image data, and to provide the data signal to the display panel; and a scan driver configured to provide a scan signal to the display panel, wherein the W image data W corresponds to a minimum value among the R image data R, G image data G, and B image data B, wherein the R' G', and B' image data correspond to (R−W*PCC), (G−W*PCC), and (W*PCC), respectively, where PCC represents a peak control coefficient, and wherein PCC is 1 when the frame image characteristic is the normal image and PCC is equal to or greater than 0 and less than 1 when the frame image characteristic is the peak image, and wherein the PCC decreases as the contrast increases when the frame image characteristic is the peak image.

31. The display device of claim 30, further comprising an illumination sensor configured to detect ambient light around the display panel and a peak controller configured to determine a sub peak control coefficient based on the ambient light and to provide the sub peak control coefficient to the image processor, wherein the sub peak control coefficient decreases as the ambient light increases when the frame image characteristic is the peak image, and wherein the PCC decreases as the sub peak control coefficient decreases.

32. The display device of claim 30, further comprising a temperature sensor configured to detect temperature of the display panel and a peak controller a sub peak configured to determine control coefficient based on the temperature of the display panel and to provide the sub peak control coefficient to the image processor, wherein the sub peak control coefficient increases as the temperature of the display panel increases when the frame image characteristic is the peak image, and wherein the PCC decreases as the sub peak control coefficient decreases.

33. The display device of claim 30, further comprising a peak controller configured to compare a total sum of saturation with a predetermined reference to determine a sub peak control coefficient, wherein the image analyzer further calculates the total sum of saturation of the image based on the R, G, and B image data when the image characteristic is the peak image, wherein the sub peak control coefficient increases as the total sum of saturation of the image increases when the frame image characteristic is the peak image, and wherein the PCC decreases as the sub peak control coefficient decreases.

34. The display device of claim 30, further comprising:

an illumination sensor configured to detect ambient light around the display panel and a first peak controller configured to determine a first sub peak control coefficient based on the ambient light and to provide the first sub peak control coefficient to the image processor; and a temperature sensor configured to detect temperature of the display panel and a second peak controller configured to determine a second sub peak control coefficient based on the temperature of the display panel and to provide the second sub peak control coefficient to the image processor, wherein the first sub peak control coefficient decreases as the ambient light increases when the frame image characteristic is the peak image, and wherein the second sub peak control coefficient increases as the temperature of the display panel increases when the frame image characteristic is the peak image, and wherein the PCC decreases as the first sub peak control coefficient or the second peak control coefficient decreases.

* * * * *